US007380348B2

(12) United States Patent
Seebach

(10) Patent No.: US 7,380,348 B2
(45) Date of Patent: Jun. 3, 2008

(54) MATERIAL DEWATERING APPARATUS

(75) Inventor: Christopher Frederick Neilan Seebach, Kenmare (IE)

(73) Assignee: Solid Solutions Limited, Kenmare, County Kerry (IE)

( * ) Notice: Subject to any disclaimer, the term of this patent is extended or adjusted under 35 U.S.C. 154(b) by 0 days.

(21) Appl. No.: 10/512,824

(22) PCT Filed: Apr. 29, 2003

(86) PCT No.: PCT/IE03/00062

§ 371 (c)(1),
(2), (4) Date: Jun. 3, 2005

(87) PCT Pub. No.: WO03/092902

PCT Pub. Date: Nov. 13, 2003

(65) Prior Publication Data

US 2005/0217224 A1 Oct. 6, 2005

(30) Foreign Application Priority Data

Apr. 29, 2002 (IE) ..... S020321

(51) Int. Cl.
*F26B 5/08* (2006.01)

(52) U.S. Cl. ..... 34/326; 34/361; 34/378; 34/548; 34/579; 34/594

(58) Field of Classification Search ..... 34/312, 34/326, 359, 361, 378, 548, 576, 579, 594
See application file for complete search history.

(56) References Cited

U.S. PATENT DOCUMENTS

| | | | | |
|---|---|---|---|---|
| 2,921,646 | A | 1/1960 | Poole | |
| 3,305,940 | A * | 2/1967 | Isler | 34/593 |
| 3,360,908 | A * | 1/1968 | Baily | 55/347 |
| 3,802,167 | A * | 4/1974 | Turman | 73/864.31 |
| 3,941,609 | A * | 3/1976 | Stern | 106/403 |
| 4,180,391 | A | 12/1979 | Perry, Jr. et al. | 55/324 |
| 4,831,971 | A * | 5/1989 | Ott et al. | 123/25 A |
| 4,833,793 | A * | 5/1989 | White | 34/443 |
| 6,158,145 | A * | 12/2000 | Landon et al. | 34/364 |
| 7,040,557 | B2 * | 5/2006 | Graham et al. | 241/1 |

* cited by examiner

*Primary Examiner*—S. Gravini
(74) *Attorney, Agent, or Firm*—Jacobson Holman PLLC

(57) ABSTRACT

The invention provides a pneumatic dewatering apparatus (1) for wet product. The apparatus (1) comprises essentially a cyclone chamber (2) connected to a centrifugal fan (3). Various vortex flow forming stations (6), each followed by a vortex shedding station (7), are mounted within the cyclone chamber (2). Tight centripetal vortices are formed and are then shed such that water is delivered out the cyclone chamber (2) into a sump (42).

53 Claims, 30 Drawing Sheets

MATERIAL DEWATERING APPARATUS

This is a nationalization of PCT/IE03/00062 filed Apr. 29, 2003 and published in English.

The present invention relates to a pneumatic dewatering apparatus for wet product comprising a cyclone chamber connected to a fan with blades, each blade causing individual flow vortices to be formed downstream of the fan which in turn combine to form cyclonic flow within the cyclone chamber. It further relates to a pneumatic method of dewatering wet product.

Such apparatus is already well known, such as, for example, the apparatus for granulating, drying or de-watering a material as disclosed. In PCT Published Specification No. WO 98/35756 (Next Century Technologies Limited), one of the inventors of which is the inventor of the present application. The apparatus comprises an impeller suction fan and a cyclone chamber that can be varied in length to produce a range of, harmonics.

Drying is effected through a known dewatering apparatus or this type, we believe, ionization, the use of harmonics and turbulent impaction with the impeller. Such apparatus is capable of drying sewage with 20% plus of solids and can usually only recover between 30% and 60% of material which usually have polymers. The problem is that the rest of the material collects along the walls of the apparatus on the impeller blades and indeed throughout the whole equipment Thus, for dewatering of sewage, it is unsuitable unless the sewage is pretreated. Untreated sewage is usually about 3% solids or even less requiring a filter press or a centrifuge to even get the concentration down to 15% or 20% solids after adding polymers. Further, thermal drying is then required to get a waste product with 90% to 95% solids. There is thus unfortunately a need to use a dryer to treat raw sewage. This requires a processing apparatus capable of fully treating sewage and other materials with a solids content less than 20% and also capable of recovering a greater percentage of untreated material. The present invention is directed towards providing a departure from the accepted state of the art with an improved construction of such apparatus using several scientific principles in a novel sense.

STATEMENTS OF INVENTION

According to the invention, there is provided a pneumatic de-watering apparatus for wet product comprising a cyclone chamber connected to a fan with blades, each blade causing individual flow vortices to be formed downstream of the fan which in turn combine to form cyclonic flow within the cyclone chamber characterized in that the cyclone chamber comprises at least a vortex flow forming section having vortex flow forming means to cause reformation of vortex flow within the cyclone chamber on dissipation of the vortex flow along the cyclone chamber remote from the fan. While if is known to produce such cyclone chambers, heretofore there has been no attempt to reform the vortex or, more importantly, to concentrate the vortex within the cyclone chamber. It will be appreciated that as the air is drawn through the cyclone chamber, the cyclone dissipates towards its proximal end. By re-concentrating and reforming the vortex flow, considerable efficiencies area achieved.

In one embodiment of the invention, the cyclone chamber comprises a vortex flow shedding section fed by the vortex flow forming section. This construction is unique because now within the cyclone chamber, there is a controlled vortex flow shedding immediately following vortex formation and in this way, the material can be treated under controlled conditions.

In one embodiment of the invention, the vortex flow shedding section is downstream of the fan, the vortex flow shedding section being arranged and configured such that the individual vortex flows developed by each fan blade are substantially destroyed within the vortex flow shedding section. It is believed that these individual vortices, that is to say, the individual vortex flows, when they are allowed progress, as it were, through the whole of the cyclone chamber, they effectively form a long winding high friction vortex it has been envisaged that if those individual vortices can be shed adjacent the fan, this greatly facilitates the virtually friction-free centripetal vortex flow formation of a single vortex flow ability to generate various forms along the cyclone chamber which acts much better than would be expected to dewater the material. It is, however, envisaged that this may not all be destroyed in a first vortex flow shedding chamber but may in fact require further vortex flow shedding chambers along the cyclone chamber to achieve the necessary result.

It is envisaged that this construction of individual vortex flow may be one of the most important things that can be carried out within the cyclone chamber.

Thus, in an apparatus, there is more than one pair of vortex flow forming sections and associated vortex shedding section.

Ideally, the blades of the fan are arranged to direct the individual vortices to meet at a focal point within the vortex flow shedding section adjacent the fan and the vortex flow forming section feeding that vortex flow shedding section is arranged to direct the main vortex flow to the same focal point it is understood that the individual centrifugal vortices from each of the fan blades, when they meet at that focal point, are met by the centripetal vortex formed in the flow forming section. Therefore, the contrary vortex flows meet at this point if, for example, one is centrifugal and the other is centripetal, there will be more shear forces and interaction causing the vortex to be shed very much within this vortex flow shedding section. Needless to say, it is not entirely necessary that all the individual flow vortices be destroyed in the first vortex flow shedding section. It will be appreciated that the rest could be destroyed within the fan casing or indeed if there are some individual vortices still present further down the cyclone chamber, that is to say, towards its proximal end where material is introduced into the cyclone chamber, they can be destroyed anywhere along the cyclone chamber.

Ideally, the vortex flow is a centripetal vortex flow. This is the preferred type of vortex flow and has considerable advantages in treating, for example, wet sewage.

There are provided various forms of vortex forming means such as, for example, a vortex forming device substantially centrally mounted within the vortex flow forming section which vortex forming device can be in the form of an egg with its narrower section facing downstream; a substantially ellipsoid body, a substantially ovaloid shaped body or a body of reducing cross section from its upstream end to its downstream end. Further, additional vortex flow forming vanes are mounted on the interior of the device.

Further, the vortex flow forming device may comprise a plurality of vortex flow forming vanes mounted around a central core.

The vortex flow forming device may comprise vortex flow forming vanes mounted on an interior surface of the vortex flow forming section. All of these various constructions have two functions, firstly to reform the vortex, but even more importantly, to cause the vortex flow to be concentrated into a tight winding vortex, generally a centripetal vortex. However, it is envisaged that alternative centrifugal and centripetal vortices may be formed to cause further agitation and disturbance of the flow throughout the cyclone chamber.

The vortex flow forming section may obviously be of the one constant cross-section throughout or may be of reducing cross sectional area towards its downstream end and may be circular in cross section; is then oval in cross-section; ideally, with the latter, when the vortex flow forming section is oval in crosssection, there is provided an indentation of arcuate shape formed in the outer portion of the vortex flow forming section. This indentation may be spirally wound around the vortex flow forming section. Indeed, the vortex flow forming section itself may be spirally wound along its length, that is to say, about it's own longitudinal axis. In turn, the vortex flow forming section is configured to form a three dimensional spiral.

In one embodiment of the invention, the or each vortex flow forming section comprises a reducing cross-section projecting into the vortex flow shedding section.

In another embodiment of the invention, the vortex flow forming section comprises vortex flow forming means adjacent where it discharges into the vortex shedding section.

In a still further embodiment of the invention, the vortex flow forming section comprises a straight section of constant cross-sectional area.

In one embodiment of the invention, the or each vortex flow shedding section is of greater cross-sectional area than that of the vortex flow forming section downstream of it to provide an expansion chamber for the main vortex flow.

In another embodiment of the invention, the or each vortex flow shedding comprises a vortex flow shedding device mounted therein, which vortex flow shedding device may be formed form a plurality of bars projecting transversely across the section or may comprise a hollow body expanding in the downstream direction and having an open downstream facing mouth or a hollow prism having an open downstream facing mouth or a sphere. When the vortex flow shedding device is a sphere, the sphere may be hollow and has an open upstream facing mouth.

In another embodiment of the invention, the vortex flow shedding device comprises vanes mounted within the vortex flow shedding section to impart contra flow to the main vortex flow. The vortex flow shedding device may be mounted on the inner wall of the section.

When the vortex flow shedding device is a hollow body, the interior of the vortex flow shedding device is connected to a vacuum source.

In another embodiment of the invention, the or each vortex flow shedding section from its downstream end has an increasing cross-section and then a reducing cross section.

In another embodiment of the invention, a venturi tube is connected between a vortex flow shedding section and a vortex flow forming section to induce a negative pressure in the vortex shedding section.

In a still further embodiment of the invention, at least some of the sections comprises cavitation forming means.

In another embodiment of the invention, the interior walls of at least some of the sections are crimped to form transverse alternate ridges and hollows to provide the cavitation forming means or may be dimpled to form the cavitation forming means.

In a still further embodiment of the invention, the interior wall of at least some of the sections comprises an inner perforated wear plate forming the cavitation forming means.

In another embodiment of the invention, an ozone plasma generator is provided.

In a still further embodiment of the invention, the fan blades comprise cavitation forming means.

Further, the fan housing comprises cavitation forming moans. The cavitation forming means is formed by a plurality of through holes in the fan blades or by a wear plate having through holes. Further, it will be appreciated that any other form of cavitation forming means, such as described above, may be used in the formation of the fan blades.

Ideally, the fan discharges into a low pressure environment to prevent water reformation, which low pressure environment may be provided by a plurality of additional cyclones.

In the apparatus, water bleed-off of pipes are provide along the sections.

Further, the apparatus may comprise an ionization device.

In another embodiment, the fan may be a centrifugal fan.

In another embodiment, the wall forming the cyclone chamber has mounted on it a magnetic sleeve, the inner wall facing surface having a polarity opposite to that of the ions generated adjacent the inner wall.

Ideally, a magnetic sleeve is surrounded by an outer ferrous sleeve.

Finally, the invention provides a pneumatic method of dewatering wet product comprising:

introducing the wet product into a cyclone chamber;

delivering air into the chamber;

successively forming and shedding vortices within the chamber to violently treat the product to cause the relevant constituents to atomize, expand, boil, chill, shear, gasify, disassociate and cavitate.

DETAILED DESCRIPTION OF THE INVENTION

The invention will be more clearly understood from the following description of some embodiments thereof, given by way of example only, with reference to the accompanying drawings, in which:

FIG. 1 is a diagrammatic sectional view of portion of an apparatus according to the invention, FIGS. 2(*a*) and 2(*b*) are details of portion of the apparatus of FIG. 1, FIG. 3 is a detail of FIG. 1 showing formation of a vortex in part of the apparatus, FIG. 4 is a further detail of FIG. 1 showing other vortices formed, FIG. 5 illustrates a modification of the apparatus of FIGS. 1 and 2, FIG. 6 is a diagrammatic view of an alternative construction of apparatus according to the invention, FIG. 7 is a sectional view along the lines VII—VII of FIG. 6, FIG. 8 is a sectional view of portion of the apparatus along the sectional lines VIII—VIII of FIG. 6, FIG. 9 is an enlarged vertical sectional view of portion of the apparatus illustrated in FIG. 6, FIG. 10 is an enlarged vertical sectional view of a further portion of the apparatus as illustrated in FIG. 6, FIG. 11 is a sectional view similar to FIG. 7 of another arrangement, FIGS. 12 and 13 are sectional views of two constructions of cyclone chambers according to the invention, FIG. 14 is a sectional view of portion of a cyclone chamber according to the invention, FIG. 15 is a sectional view along the lines XV—XV of FIG. 12, FIG. 16 is a side sectional view of a prism forming part of the chamber of FIG. 14, FIG. 17 is an end view from upstream of the prism, FIG. 18 is an end view from downstream of the prism, FIG. 19 is a plan view of the prism, FIG. 20 is a view of a spirally wound cylindrical section forming part of the cyclone chamber according to the invention, FIG. 21 is a side elevation of an apparatus according to the invention having a vertically arranged cyclone chamber, FIG. 22 is a plan view of the apparatus, FIG. 23 is a front view of portion of the apparatus of FIG. 21, FIG. 24 is a perspective view of the apparatus of FIG. 21, FIG. 25 is a view similar to FIG. 21 of an apparatus incorporating a horizontally arranged cyclone chamber, FIG. 26 is a view of portion of a cyclone chamber incorporating an ionization device;

Figure 1:
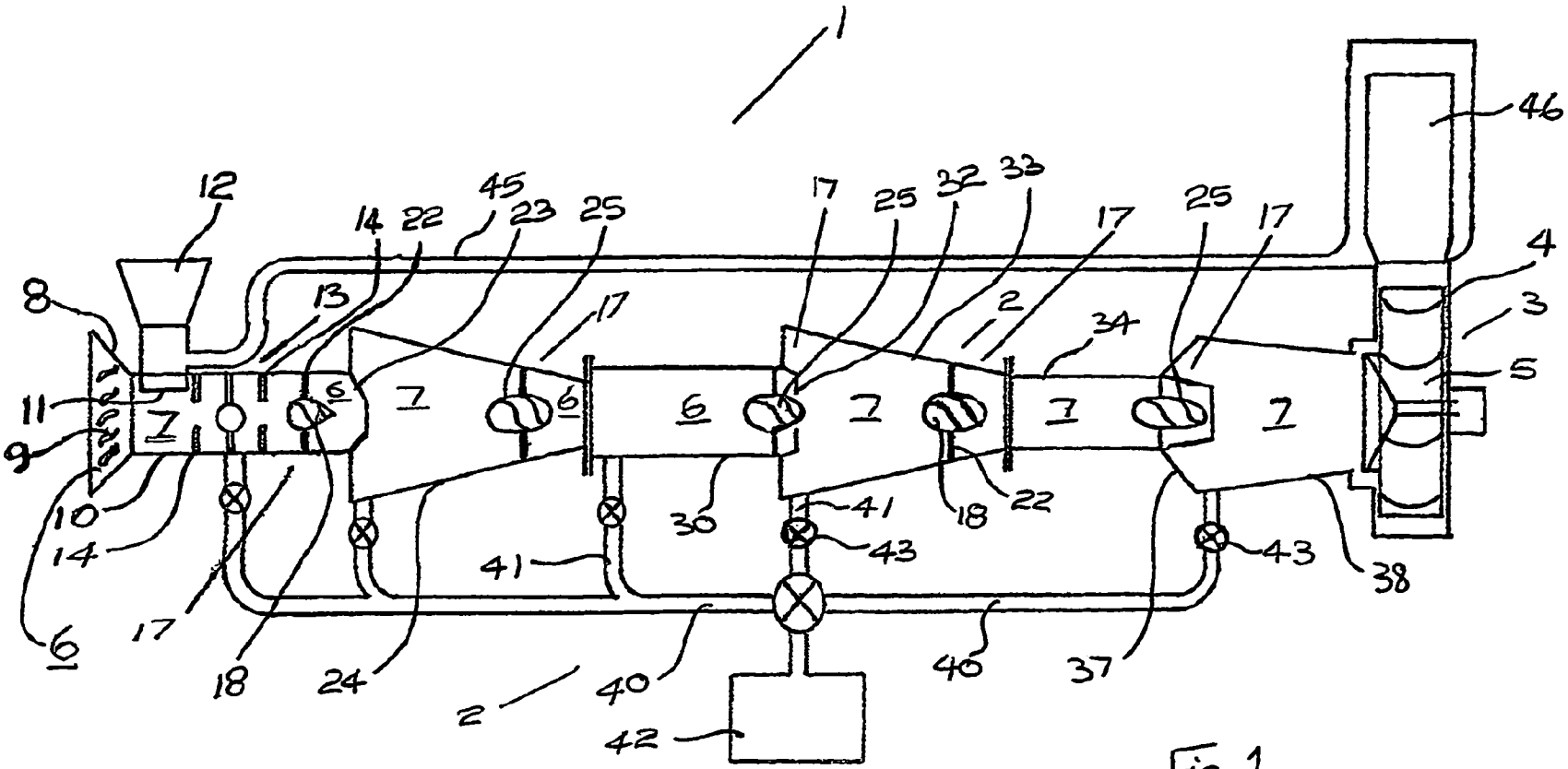

Referring to the drawings and initially to FIG. 1, there is provided a drying apparatus, indicated generally by the reference numeral 1, which comprises a cyclone chamber 2 having an impeller suction centrifugal fan 3 located within a casing or housing 4. The suction fan 3 is a substantially conventional impeller suction fan having blades 5 for creating a cyclonic air stream within the cyclone chamber 2 and is somewhat similar to the fan already described in the previously mentioned PCT Published Specification WO 98/35756 (Next Century Technologies Limited). The fan, as previously described in this specification, has been provided with a casing or housing 4 which reduces in cross-section towards the exhaust end. A toroldal or flat scroll unit surrounds the impeller. Additionally, the blades 5 of the impeller have a perforated liner with transversely arranged ridges to form cavitation forming recesses. The fan 3 is generally one which imparts centrifugal flow but may impart centripetal flow.

The cyclone chamber 2 is divided up into a number of sections, not always physically different, such as one would expect from examination of FIG. 1, but into sections having different functions, namely, a vortex flow-forming section 6 and a vortex flow shedding section 7. In some cases, as can be seen from FIG. 1, the sections are quite physically distinct and, in other cases, they are not. However, in each case, a vortex flow forming section 6 is followed by a vortex flow shedding section 7. For example, the casing or housing 4 of the fan, as is normal, provides a vortex flow shedding section, although it is not identified as such. Further, again, when a vortex flow has been formed, the section in which the vortex flow is travelling, after having been formed, has, strictly speaking, a vortex flow shedding function in that the vortex flow tends to be dissipated along it, particularly if the vortex flow is carrying out work and disruption of the material. However, for convenience, it is easier to describe them as distinct sections.

Figure 2:
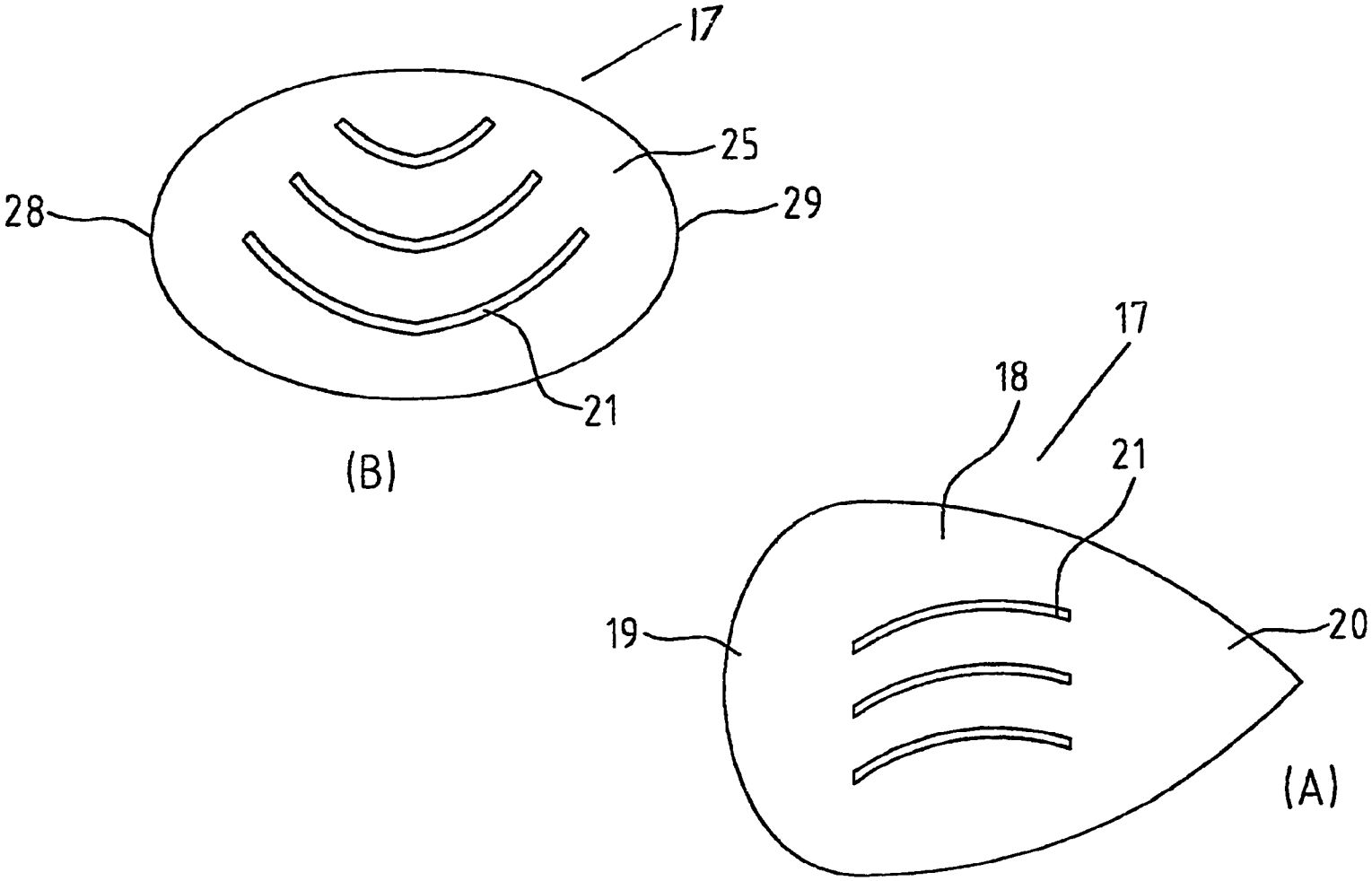

The cyclone chamber 2 comprises at its downstream or proximal end, a frusto-conical air inlet 8 having vortex flow forming vanes 9 on the interior surface thereof and is thus a vortex flow forming section 6. The frusto-conical air inlet 8 feeds a cylindrical portion 10 into which projects, at 11, a material infeed hopper 12. The cylindrical portion 10 forms a vortex flow shedding section 7 and a vortex flow forming section 6. The vortex flow shedding section mounts vortex flow shedding means, namely, a plurality of vortex flow shedding devices, indicated generally by the reference numeral 13. The vortex flow shedding devices 13 comprise a plurality of bars 14 projecting some way into the vortex flow shedding station 7. The bars 14 project into the vortex flow shedding station 7 so as to incline at various inclinations to the interior downstream and upstream of a further vortex flow shedding device 13 formed by a sphere 15 mounted centrally within the vortex flow shedding section 7 by radially arranged support arms 16 which will also have a vortex flow shedding function. The vortex flow shedding section 7 feeds into a vortex flow forming section 6 having vortex flow forming means provided by a vortex flow forming device indicated generally by the reference numeral 17. In this embodiment, an egg-shaped device, hereinafter, for simplicity, an egg 18, illustrated in more detail in FIG. 2(*a*). The egg 18 has an upstream portion 19 which is broader than its downstream portion 20. Vanes 21, for assisting in establishing vortex flow, are mounted on the exterior surface of the egg 18. The egg 18 is mounted by radially arranged bars 22 within the vortex flow forming section 6. Thus, the vortex flow forming station 6 is provided which then discharges via a reducing cross sectional portion 23 of the cylindrical portion 10 into a vortex flow shedding station 7 of reducing cross sectional area, namely, a frusto-conical shaped section 24 of the cyclone chamber 2, which then communicates with another vortex flow forming section 6, namely, another egg 18 also within the section 24, which again has a vortex flow forming device 17 mounted therein.

Mounted beyond the vortex flow shedding section 7 is a further vortex flow forming device 17 providing another vortex flow forming station 6. The vortex flow forming device 17, in this embodiment, is a further egg 25 (illustrated in more detail in FIG. 2(*b*)), mounted again by rods 26 in the section 24 of the cyclone chamber 2. The egg 25, in this particular construction of egg 25, has further vortex flow forming and directing vanes 27 and additionally this egg 25 is symmetrical about its vertical axis such that its downstream end or proximal end 28 is of the same shape as its upstream or distal end 29. Then, the frusto-conical portion 24 discharges into another cylindrical portion 35. This cylindrical portion 30 again forms part of the vortex flow forming section 6. It will be appreciated that there will be a certain amount of flow shedding or dissipation taking place now within the cylindrical portion 30.

Then, adjacent an exit 32 of the cylindrical section 31, which again is of reducing cross section, there is mounted a further egg 25. This egg 25 again concentrates the vortex flow that may have been slightly dissipated in the vortex flow forming section 6 so that a tight vortex is then delivered into the next part of the cyclone chamber 2, namely, a frusto-conical portion 33. The frusto-conical portion 33 houses a further vortex flow forming device 17, again provided by an egg 18. The vortex flow forming station 6 continues on into a further cylindrical portion 34 which again has a discharge outlet 35 of reducing cross-section into a further vortex flow shedding station 7. Mounted in the discharge outlet 35 is a further egg 25. This vortex flow shedding station 7 is formed in another portion of the chamber 2 and comprises initially an expanding portion 37 which in turn leads into a portion 38 of decreasing cross-sectional area.

A main water drain-off pipe 40 is fed by a plurality of further drain-off pipes 41; each incorporating non-return valves 43. The pipe 40 feeds a sump 42. The drain-off pipes 41 are connected at various places to the cyclone chambers 2. A material return pipe 45 connects an outlet hopper 46 for the fan 3 to the material infeed hopper 12 for recirculation of material.

It will be appreciated that, for example, the two eggs 18 and 25 are interchangeable and that similarly, whether they mount respectively vanes 21 and 27, is optional.

Ideally, the vortex flow shedding bars 14 can be provided by vertically scored threaded bolts because their roughened surface is ideal for vortex shedding. The bars 14 also act as a safety device preventing, for example, a person's hand being dragged into the cyclone chamber.

In operation, wet material such as, for example, wet sewage is introduced into the inlet hopper 12 from which it is delivered at 11 into the vortex flow shedding station 7 where it is impinged upon by air drawn through the inlet 8 which has been imparted with vortex flow by the vanes. Then the vortex flow is destroyed in the vortex flow shedding section 7 by the vortex flow shedding devices, namely, the bars 14 and the sphere 15. Any vortex flow that has not been dissipated will then be dissipated as the flow hits the egg 18 at its downstream end 19. Then the egg 18 and vanes 21 will cause vortex flow to be reformed and a tight centripetal vortex will be formed adjacent the downstream portion 20 of the egg 18. This vortex flow then delivers out into the vortex flow shedding section 7 which is provided by the frusto-conical portion 24 of the cyclone chamber 2. This frusto-conical portion 24 forms an expansion chamber such that a vacuum will be formed behind the vortex flow being delivered into the vortex flow shedding station 7. Then, the material and air is delivered down through various vortex flow forming and vortex flow shedding stations to the fan 3.

It should be noted that the description of how the invention works is our best endeavor to describe the operation of the invention as it is understood on filing this application. However, it is essential to appreciate that it is not by any means certain that this is precisely the way the invention works, however, the explanation is given as that this is the hypothesis upon which the machine was designed and being what we believe to be the way in which the invention operates. However, it is emphasized that further work needs to be carried out to prove or disprove the theory postulated herein.

It must further be appreciated that the veracity or otherwise of the theory of the operation of the invention is, to a certain extent, irrelevant.

As the material is drawn through the cyclone chamber, a tight vortex is formed, then it is shed and then it is formed again. In this way, some of the water, for example, in the sewage, is vaporized through cavitation. Then, this water condenses against the inner wall of the cyclone chamber and is drawn off through the pipes 41 and sump 42.

In the cyclone chamber 1, all our observations to date have shown that the vortex flow appears to be tighter than that that would be produced by an impeller alone, which latter vortex flow, as is normally produced in a cyclone chamber, can be referred to as a long winding low energy vortex.

In each frusto-conical portion, namely, the portion 24 and the portion 33, as well as the portion 37, which effectively form expansion chambers, it appears that there is a sudden and violent expansion of the vortex flow or the cyclone so-formed, and this expansion causes the denser particles in the material virtually to explode and pulverize. There is then further evaporation of residual water which again could be delivered to the sump 42. Eventually, substantially dry sewage is delivered to the fan 33 where further dewatering and pulverization of the drying materials is achieved within the housing 4 as is known. If, by any chance, some of the material is too wet, then it is fed back in the return pipe 45 for further processing.

It is now appropriate to deal with the phenomena which appear to occur during operation of the apparatus.

The earlier invention described in Patent Specification No. WO 98/35756 was based on the principle that the centrifugal vortex created by the fan in an expansion frusto cone released the energy of the feedstock contained in a high pressure sleeve enroute to a low pressure area and an explosion took place. Centrifugal vortices are explosive and expansive and therefore produce heat, noise, friction, energy consuming and are out winding. Centripetal vortices are lust the opposite: implosive, contractive, produce cold, silent have no friction energy generating and are in winding. It was necessary to utilize and isolate the beneficial explosive force by inserting a centripetal forming device such as an egg at the point of entry into the pipe facing the fan and dispersing the flow so that it may be utilized in optimum configurations upstream in a non friction environment (suction vs pressure) and allowing many times the residence time, amount of available energy efficient and silent work.

An inward-moving, densifying water vortex from the perspective of Reynolds numbers, is that the laminar flow is made to self-conform as it collapses in on itself —Nature's self-ordering force which Viktor Schauberger called biological magnetism. It is well known that a centripetally flowing fluid can create tremendous turbulence to anything which resist it—for example, a tornado. Tornadoes form out of layers of hot and cold air which move upon one another; Out of the rather chaotic situation, we have the formation of an organized flow of energy of several kinds. There is an electrical potential created between the upper rim (positive ions) and the central bottom of the vortex (negative ions). There is also a temperature gradient—a self-organizing condition which draws heat from the surrounding medium and puts it to use. Large tornadoes and obviously hurricanes contain amounts of energy equivalent to nuclear weapons. It is suggested that if one could provide what is in effect a tornado in a box, it has the potential to be more powerful than nuclear fission. It is believed that the wet sewage or sludge is now drawn into the center of the in-winding compressed and accelerating vortex along the longitudinal axis where it is immediately compressed. Whether the core of this vortex is inherently electrical; positive in nature or not is debated in text books but all agree that there is a presence of predominantly positive hydrogen ions and it is moot whether it is a polarity of the charge species of hydrogen found at the horizontal core or a subsequent charge force which attracts these ions. Conversely oxygen ions are at the center of a centrifugal vortex with the hydrogen ions expelled. It is believed that the centripetal cyclone formed or vortex flow is such that, the water presence in the sewage forms compressed hydrogen such as hydronium ($H_3O$) and partially dissociates forming ionized radicals of high energy oxygen radicals and hydrogen radicals.

The egg producing the centripetal vortex of in-winding vortex produces enough force (96%)—(F=ma where text books consider acceleration in terms of a linear force such as hydraulics or centrifugal explosive force but not accelerating rotational force such as tornados [in this case up to four times the speed of sound]). This is only a novel approach to a standard principle and no doubt will foster other energy saving or generating devices to coerce water to its densest point whereby an anomaly is produced and impurities and heavier oxygen radical ions are, we suspect, squeezed out like a sponge perhaps explaining why water at this temperature (4 degrees C.) cannot hold impurities. The hydrogen molecules in various forms travel along the horizontal axis and the negatively charged oxygen radical ions with their heavier specific gravity are expelled radially into the 4% energetic centrifugal reflex at theoretically 5000 M/sec whereby it is mixed with bacteria filled sludges and promotes disinfection while it travels along perforated liners and/or transverse ridges being cavitated and atomized.

Thus, the oxygen radicals with their heavier specific gravity appear to be repelled by this cyclone core towards the periphery of the cyclone. At the periphery of the cyclone, there is thought to be a vacuum interface between the inner vortex, i.e. the inner cyclone having a centripetal action with high velocity thought to exceed the speed of sound and the outer vortex having a centrifugal action at an even higher velocity which attempts to form a braking action assisted with vanes on the inner surface of the conduit. (This natural phenomenon is similar to electrical current creating a magnetic braking effect which gives it its coherency hence the inventors term "positive-electric/negative-magnetic" implicating that they may be of the same substance just going in opposite directions). It is believed the outer vortex comprises a plurality of micro-vortices. Also being directed towards the periphery of the various cylindrical section are particles of sewage. As the heavy oxygen radicals and particles of sewage reach the periphery, there is a vacuum formed at the periphery and there is apparently a counter balancing centrifugal outwinding vortex (equal and opposite reaction) just beyond this vacuum boundary, as mentioned above, which causes the generation of compensating heat (to the 4° C. centripetal source) at the periphery of the cyclone chamber. This peripheral centrifugal cyclone inherently carries, we believe, a discharging force which attracts or consists of the negatively charged oxygen radicals. It is also believed that the peripheral centrifugal cyclone also carries the particles of matter towards the periphery of the cyclones and shown to increase the effective vacuum within the indentation, perforated liner and/or transverse ridge.

It is suggested that an example of centrifugal action lies in front of the impeller where the blades are rotating counter clockwise and the resulting vortices are focused on an egg at the opening of the frusto-conical tube creating an opposing vortex. This violent electromagnetic shearing produces free ions in this centrifugal environment of two electrically conductive systems that spin coextensive aether which spreads out so as to overlap its counterpart aether spinning the other way so the oxygen radicals will travel the now negatively charged horizontal axis and the positive hydrogen ions will be expelled to the positively charged periphery. The blades themselves will supply the final vortex shedding and the oxygen radicals dispersed via the counter thrusting vortex of the interrupter at the hub will provide the final oxidation taking more oxygen ions out of the water reformation possibility. The centrifugal vortex flow attracts oxygen radicals to the center and throws out hydrogen and the centripetal vortex flow attracts hydrogen radicals to the center and throws out oxygen. The heat generated or released at this phase is about 30° C. and sewage or animal slurry is odourless. As a result, unlike thermal dryers, air scrubbers are not required. A major reason it was desirable to limit the centrifugal vortex as the last process in front of the fan was that the noise and friction consumed the energy so that little else could be accomplished and the sound was a considerable addition to noise pollution. This counter shearing effect is also used in the beginning of the process: where the feedstock is fed in a counter-flow to the entrained air to duplicate the aforementioned process.

As explained earlier, the water present in the sewage or indeed added water dissociates into hydrogen radicals and oxygen radicals. The oxygen radicals are high energy radicals. The oxygen with its heavier specific gravity is expelled from the center of the cyclone along with suspended matter, as dense water, which dense water, at 4°, under considerable pressure, can no longer retain the oxygen and thus is removed therefrom. The high energy oxygen radicals at the periphery collide and react with the bacteria oxidizing any bacteria and destroying them (much like the action of immune phagocytic cells oh phagocytosed bacteria within the body). This reaction causes the oxygen radicals to combine and form stable oxygen species such as molecular oxygen and is no longer as easily available for reformation with the hydrogen ion. The larger suspended solids owing to the greater density and mass are dispersed amongst the centrifugal reflex and atomized during cavitation along, usually the perforated liner, as will be described hereinafter. Then, in each of the cylindrical sections, there is, we believe, drying and sterilizing and this can be maximized by having an elongate cylindrical portion. Then the cyclone or vortex flow encounters a further egg, once again, the high energy centripetal cyclone is formed at the narrow end of the egg and the drying, sterilizing and deodorizing effect continues.

Each time the cyclone enters a portion of the cyclone chamber, where there is an increase in cross-sectional area, it is believed that a sudden and violent expansion of the cyclone and its contents occur. It is believed that firstly the sudden increase in volume causes a sudden decrease in pressure. This in turn causes the sudden expansion of gas and/or any residual water within the solid particulate matter. It appears then that this causes heat generation and there are generated explosive centrifugal vortices caused by the shedding at the edge of the entrance to curl into the vacuum area or space so formed. Thus, the larger denser particles virtually explode and are further pulverized. The smaller disintegrated matter is then centrifugally discharged to the perimeter for oxidation by the above-described processes, when the centripetal cyclone reforms itself.

Figure 3:
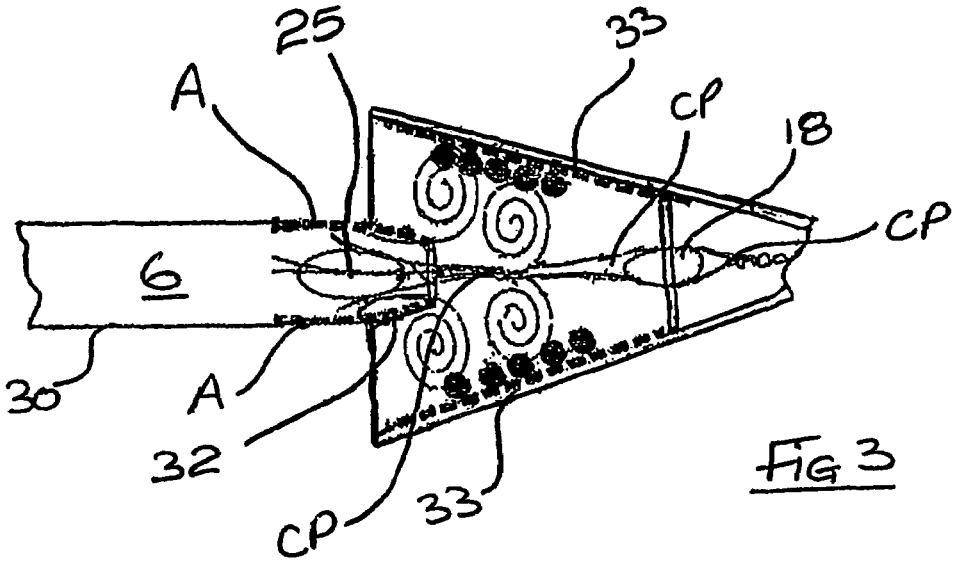

Secondly, the sudden low-pressure atmosphere, as explained above, may cause the expansion of gases and water. This sudden expansion causes the sudden release of energy as heat. The increase in temperature aids in the evaporation of any residual water. It is believed that evaporation is also aided by the pressure differential between the cyclone chamber and the frusto-conical devices. During operation, additional water can be added to the material to be processed. The rationale behind this is simple. It is believed that when more water is added, inner walls and surfaces are cleaned and further dissociation of water molecules occurs providing more oxygen radicals for serialization purposes and acts as a carrier for the material to be treated by the vortices. This dissociation of water and the movement of the oxygen radicals and sewage matter towards the periphery continues along the cyclone chamber, however, as the distance from any vortex flow forming device increases so the likely intensity and energy of the cyclone is dissipated. Thus, close placing of flow forming and shedding devices is desirable. Thus, with the invention, vortex flow forming devices are placed along the cyclone chamber so as to provide maximum intensity of vortex flow for each time when the vortex is shed. The entire process occurs in a short time, of the order of 2 seconds. As found with one apparatus constructed, in accordance with the invention, utilizing a layout similar to FIG. 1 dimensioned to accommodate a fan having an impeller have been of the order of 150 mm to 230 mm and preferably of the order of 180 mm. However, it will be appreciated that other constructions and uses may require impellers of different constructions. In practice, the apparatus will incorporate as many shredding and reestablishment treatments as possible including devices and conditions which encourage separating, dewatering or atomizing evaporating, cavitating vaporizing, gassifying and essentially drying the feedstock as much as possible and all the while, maintaining a minimum friction balance so that the net energy usage provided by the work generated via the radial axis rotation and the longitudinal axis rotation is used to its fullest potential. The number of vortex forming devices or length of cylindrical conduits is determined by the point at which a suitable load on the motor is produced and this will vary with the atmospheric conditions and the nature of the feedstock. Similarly, whether centripetal or centrifugal vortices are formed depends on the conditions encountered;

FIG. 3 illustrates portion of the cyclone chamber of FIG. 1 with portion of the inner, walls configured to form cavitation by perforated wear plates, as will be described hereinafter. The egg 25 forms a centripetal winding, identified by the letters CP, which gradually unwinds as the flow progresses and then impinges against the egg 18. Against the outer surfaces, there is, it appears, vortex shedding and boiling and at the ore of centripetal vortex flow, the temperature is of the order of 4° with concentrated hydrogen formed. Between the periphery and the centripetal vortex flow, there is a vacuum formed and a double helical centrifugal counter flow. Thus, oxygen radicals appear to be formed on the outer surfaces.

Figure 4:
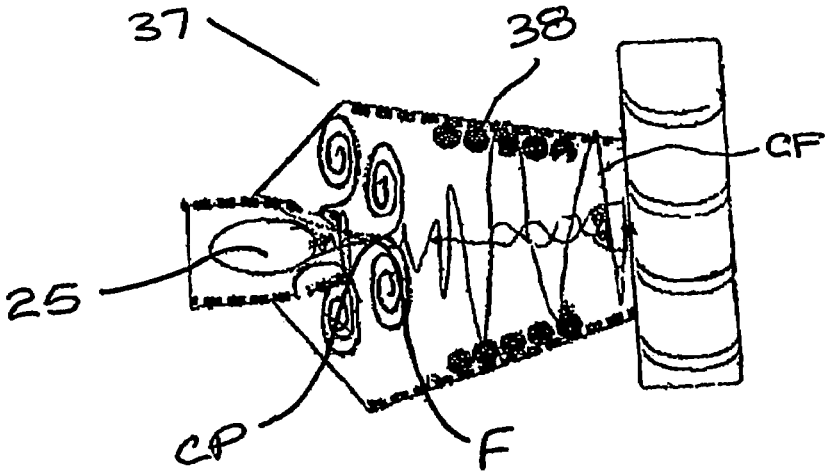

Referring to FIG. 4, there is illustrated what appears to be the flow generated at the fan 3 when it is a centrifugal fan. The egg 25 forms a concentrated centripetal vortex CP as before, while the fan blades form a centrifugal vortex CF. These both concentrate at the one focal point F and there is both centrifugal flow and centripetal flow. We suggest that the centrifugal flow will be at +30° C., while the centripetal flow will be at a much lower temperature. Even though the air is travelling in the one direction, there are counter flows established. There will then be a centripetal counter flow adjacent the portion 38. It is believed that there is free radical ion energy shearing and that there are also oxygen radicals formed outside the tight centripetal flow.

Tables 1 and 2 show the results of some tests carried out on an apparatus according to the present invention, handling various types of sludge.

TABLE 1

| Sludge Feed-rate $m^3$/hr | Sludge Type | Cake % DS In | Cake % DS Out | Air Out Odour | Product Out Odour | Pass |
|---|---|---|---|---|---|---|
| 1 | Activated Waste Water Sludge | 12% | 59.89% | Odourless | Odourless | One |
| 1 | Liquid Farmyard Slurry | 5.73% | 60.14% | Some Ammonia | Odourless | One |
| 2 | Peat/ Water 50/50 | 9.14% | 74.14% | Odourless | Odourless | One |
| 2.5 | Liquid Farmyard Slurry | 1.67% | 47.75% | Slight Ammonia | Odourless | One |
| 3 | Peat/ Water 60/40 | 19.1% | 73% | Odourless | Odourless | One |

Source: Celtic Watercare Limited Scientific Testing (Belt presses and centrifuges can achieve only 15–20% DS at a much higher cost).

TABLE 2

| Sludge Feed-Rate $m^3$/hr | Sludge Type | Cake % DS In | Cake % DS Out | Output Temp ° C. |
|---|---|---|---|---|
| 4 | Wetted Bord Na Mona Peat | 8.5% | 41.5% | 23° C. |
| 4 | Wetted Pressed Sludge from a WWTW | 16.7% | 32.9% | 26° C. |
| 4 | Settled Sludge | 3.5% | 37.3% | 22° C. |

(Source: Bord Na Mona Environmental Testing)

Table 3 shows the power consumption for treating 2.5 tonnes per hour of liquid farm slurry for the particular test carried out.

TABLE 3

PRODUCT IN

250 Kg (per hour)
Dry Solids 1.67 2500 × 1.67/100 = 41.74 solids
2500 − 41.75 = 2458.25 Kg water

PRODUCT OUT

Cake at 37.75 Dry Solids
Assume no loss of dry solids
42.75 = 0.3775 Total Cake = 110.6 Kg

WATER REMOVED 2458.25 − 68.85 = 2389.4 Kg

ENERGY CONSUMPTION

220 Kw Diesel Engine delivering 60 Kw
energy consumption per hour = 60 × 3600 = 216,000 Kj
216000/2389.4 = 90.399 Kj energy per Kg water removed.

Apparently, for this test, there was approximately 90 Kj energy per Kg of water removed which apparently compares very favorably with the normally quote of 5,000 Kj per Kg or 10,000 Kj per Kg for a thermal dryer. These are detailed in Table 3 above.

Figure 5:
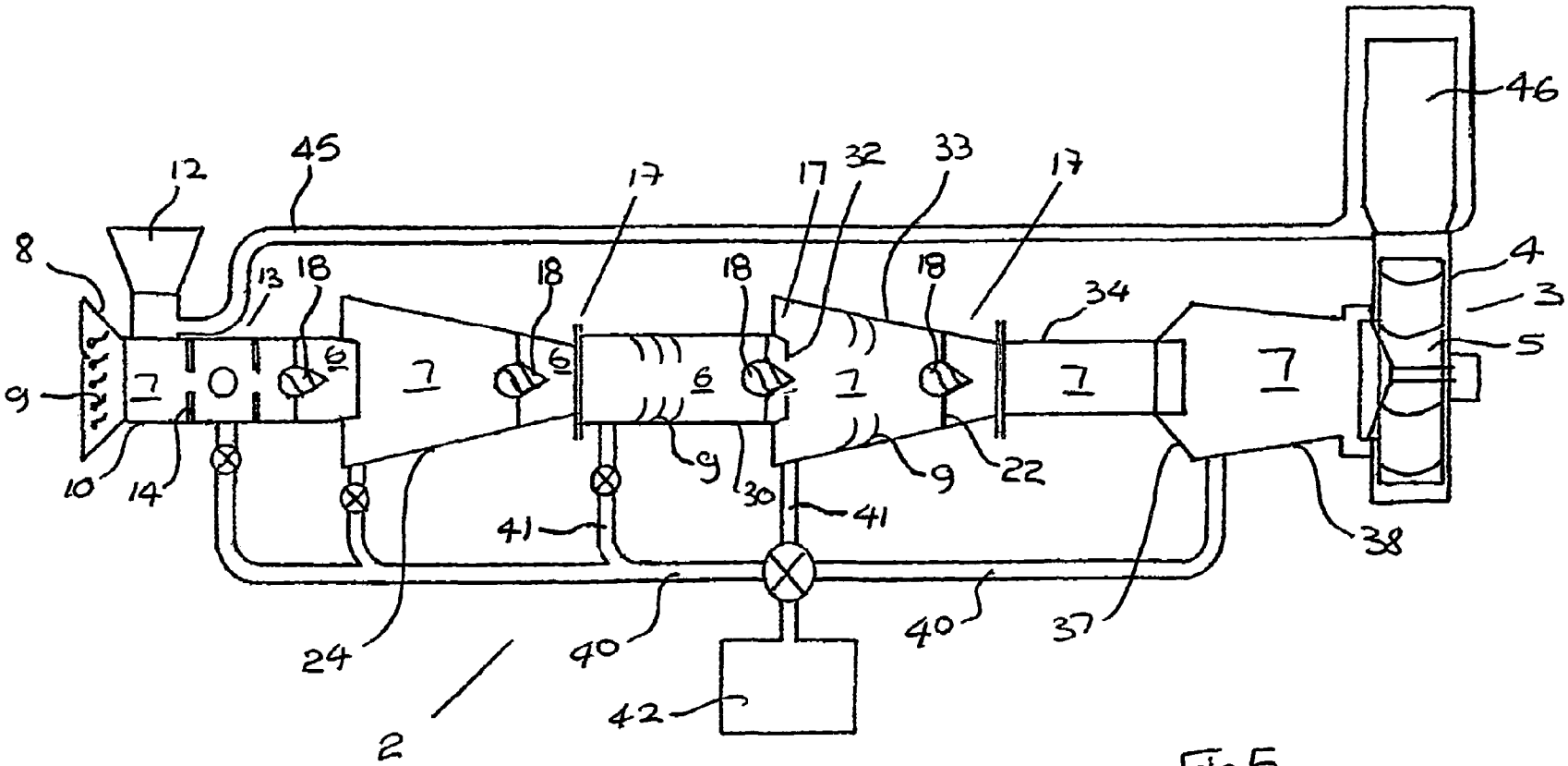
Figure 6:
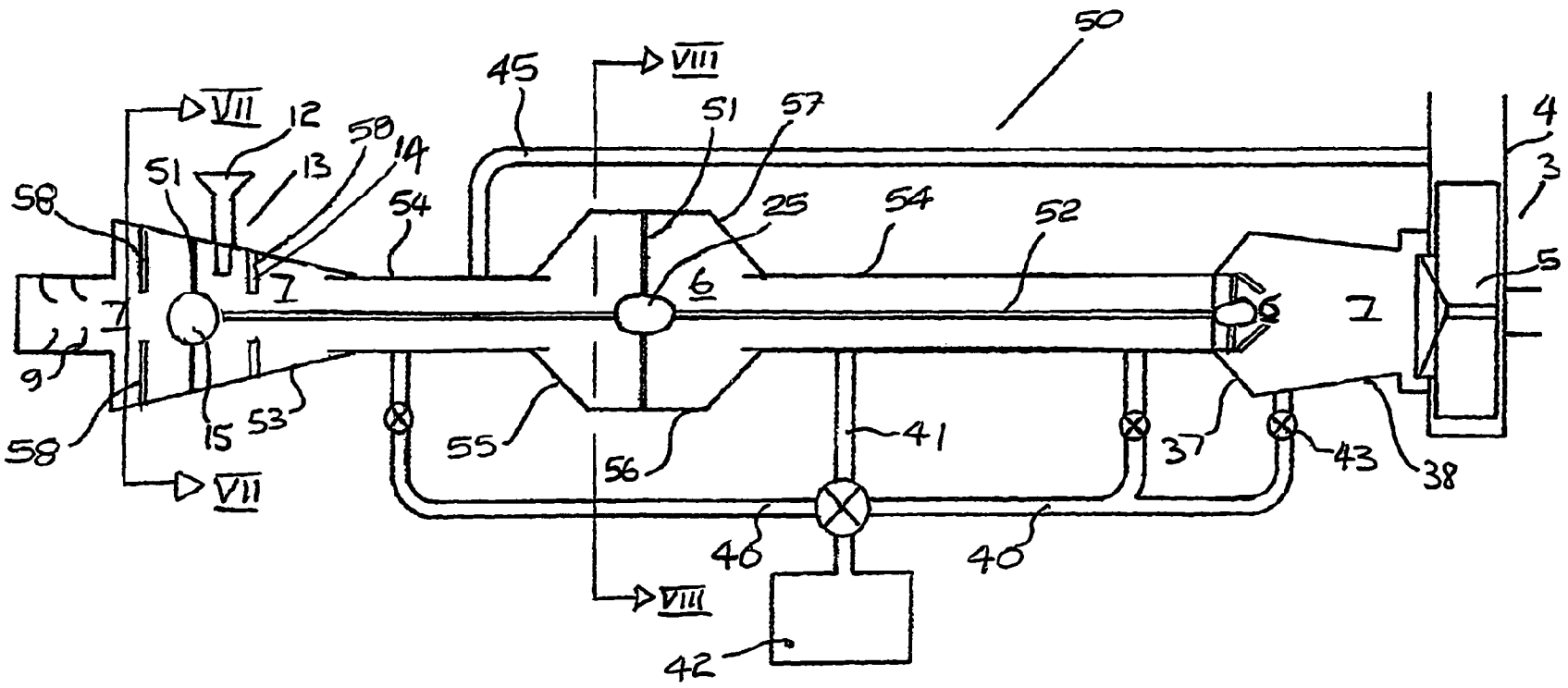

FIG. 5 shows an alternative embodiment in which the vortex flow forming devices 17 comprise only eggs 18, that is to say, all irregular shaped eggs. The eggs 18 are shown with vanes 21 which, it will be appreciated, are not essential.

Further vortex forming or shedding, as the case may be, is provided by additional vanes 9 in the interior of the cyclone chamber 2.

Referring to FIGS. 6 to 10 inclusive, there is illustrated an alternative construction of de-watering apparatus, again indicated generally by the reference numeral 1, in which parts similar to those described with reference to the previous drawings, are identified by the same reference numerals. In this embodiment, the sphere 15 and eggs 25 are mounted between three equi-spaced struts 51 and a central bar 52 projects through the cyclone chamber 2. It will be noted that each portion of the cyclone chamber 2 projects into the next portion, as is clearly illustrated in FIGS. 9 and 10. The feed hopper 12 is now positioned in a frusto-conical portion 53 and projects two thirds of the way along the sphere in the downstream direction. The frusto conical portion 53 connects with a cylindrical portion 54. Then, there is provided what is effectively an expansion chamber by a further portion of the cyclone chamber 2 comprising an increasing frusto-conical section 55, a cylindrical section 56 and a decreasing frusto-conical section 57 in the direction of the air flow and this portion then connects with a further cylindrical portion 54 which in turn feeds into a further portion 37. It will be appreciated that the whole apparatus can consist of the one elongate cylindrical chamber with various vortex flow forming and shedding sections.

Figure 7:
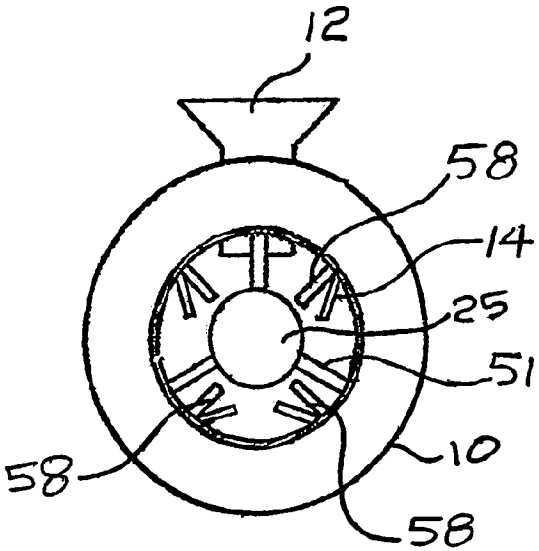

Referring in particular to FIG. 7, there is shown bars extending from the interior surface of the cyclone chamber 2 before and after the sphere 15. They are similar in function to the bars 14. These bars 58 are scored with a criss-cross pattern and it is thought such scoring aids in vortex flow shedding.

Figure 9:
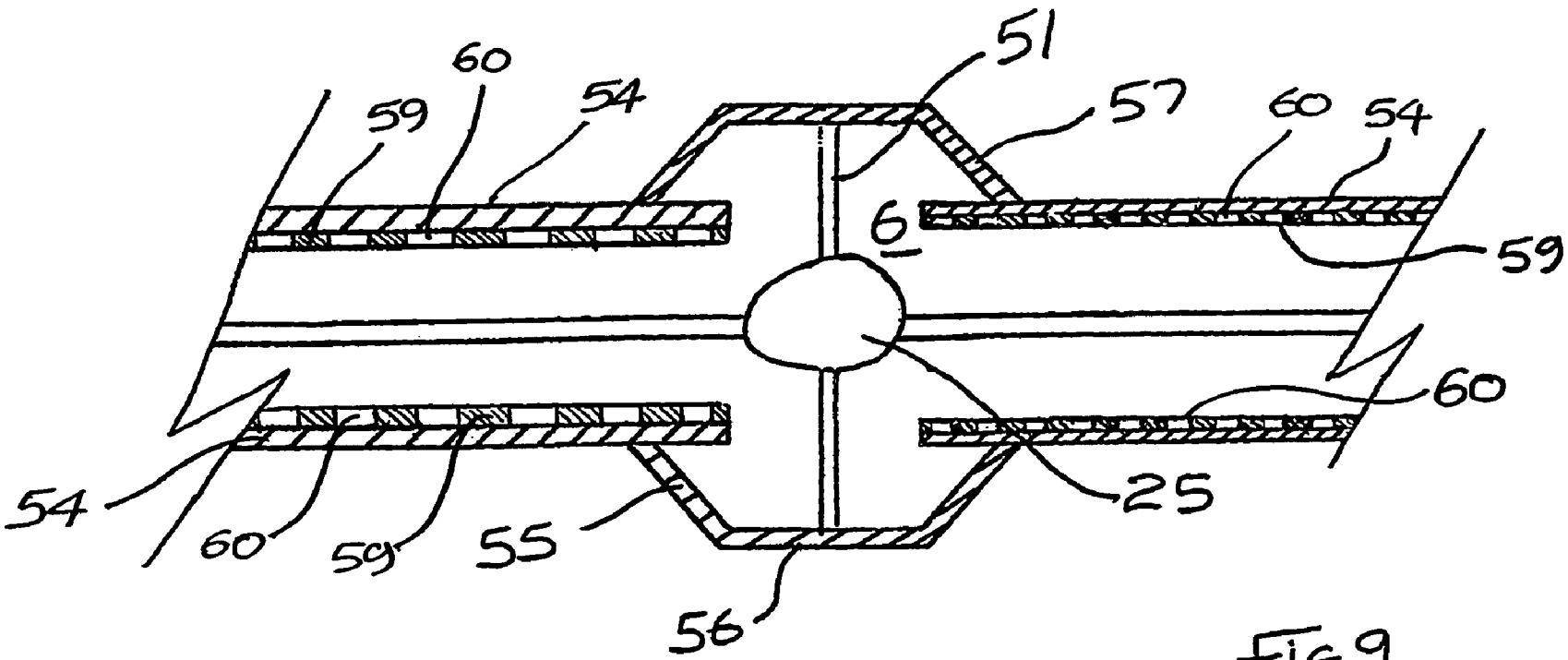
Figure 10:
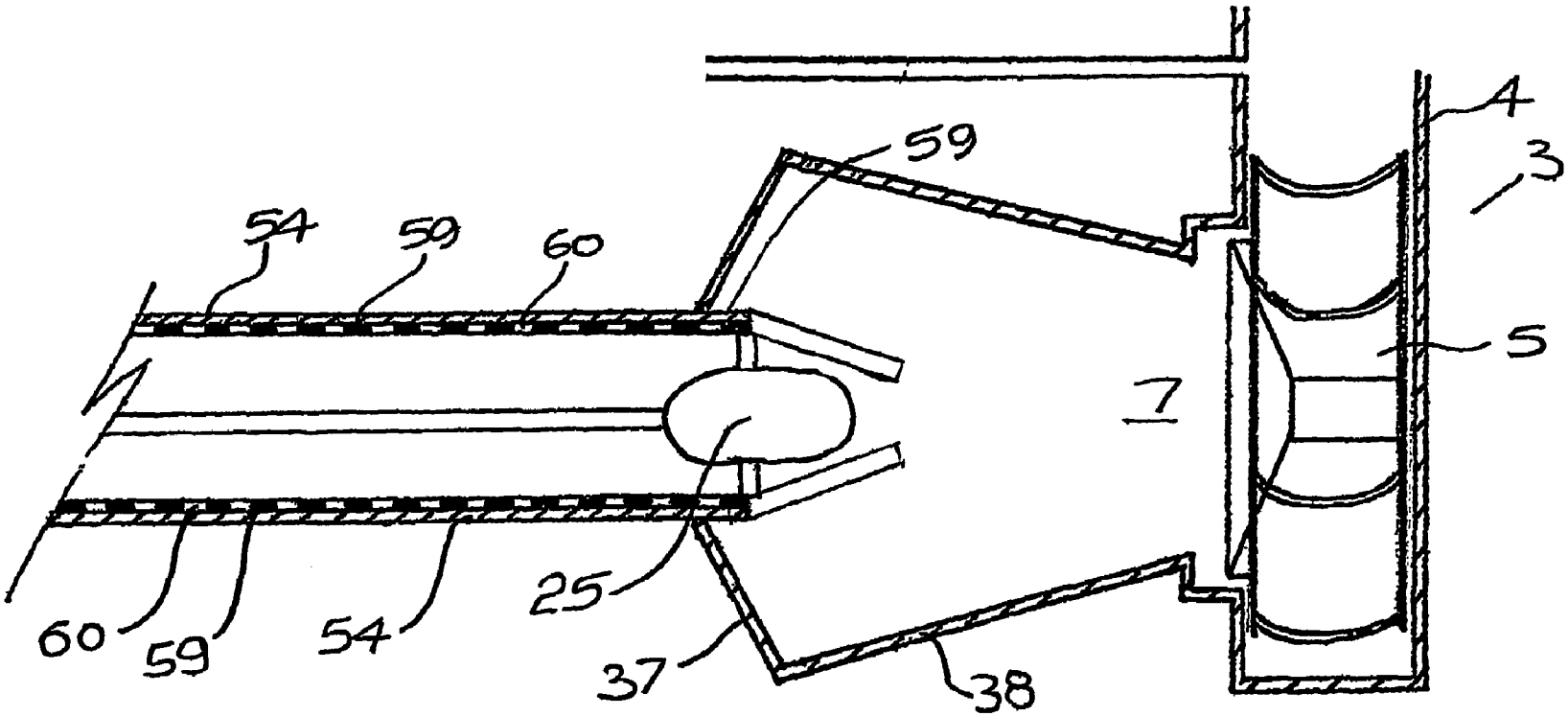
Figure 13:
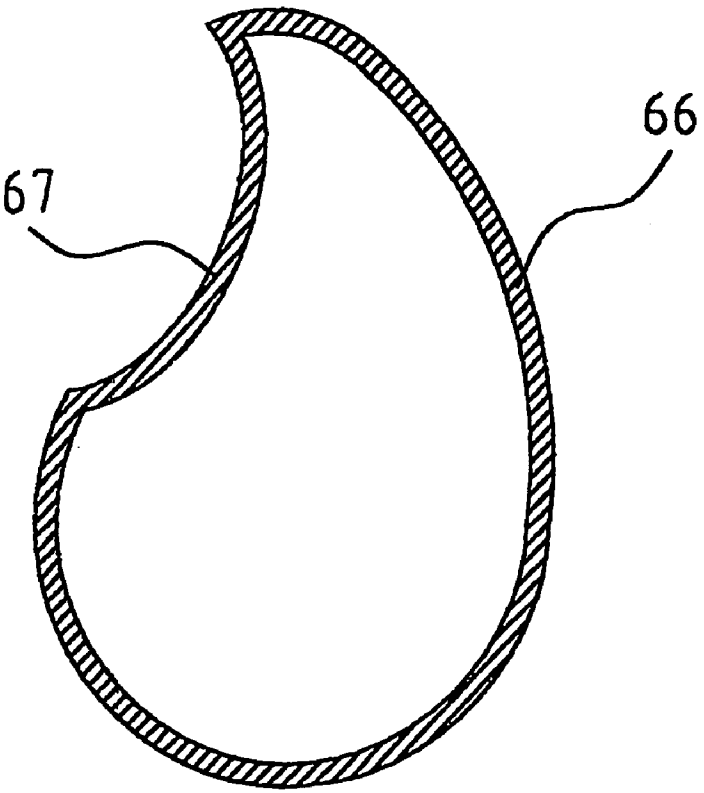

Referring now specifically to FIGS. 9 and 10, it will be noted that each cylindrical portion 54 carries a liner plate 59 having a plurality of cylindrical holes 60 which combine with the interior surface of the cylindrical portion 54 to provide cavitation forming indentations. Similar liner plates 59, as shown, can be mounted in various other portions of cyclone chamber 2 and the fan 3 and can provide wear plates in certain portions of the apparatus such as in FIGS. 3 and 4.

In use, it appears that the indentations create a vacuum believed to be via hydrosonics and causes further separation of the water. This effect can be enhanced by using a vacuum pump (not shown) to increase the effective vacuum within the indentation.

Figure 11:
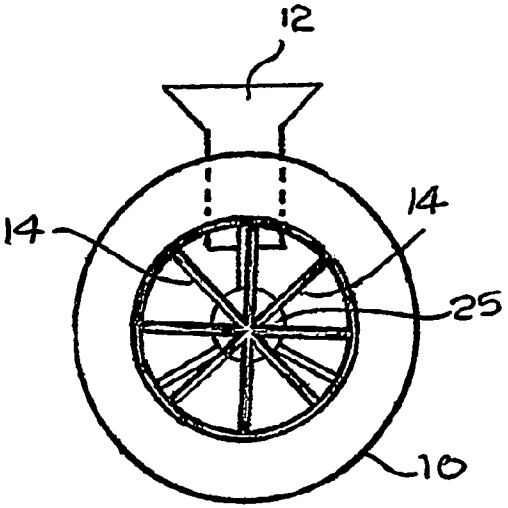
Figure 8:
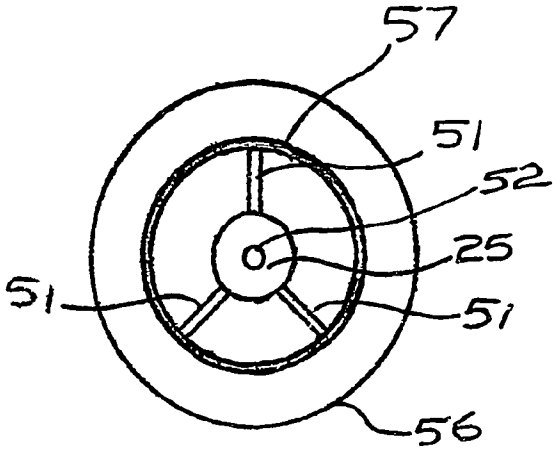

Referring to FIG. 11, which is a view similar to FIG. 7, there is shown an alternative construction in which parts similar to those described, with reference to the previous drawings, are identified by the same reference numerals. In this embodiment, the scored bars 14, in this case, project the whole way across the cyclone chamber 2.

Figure 12:
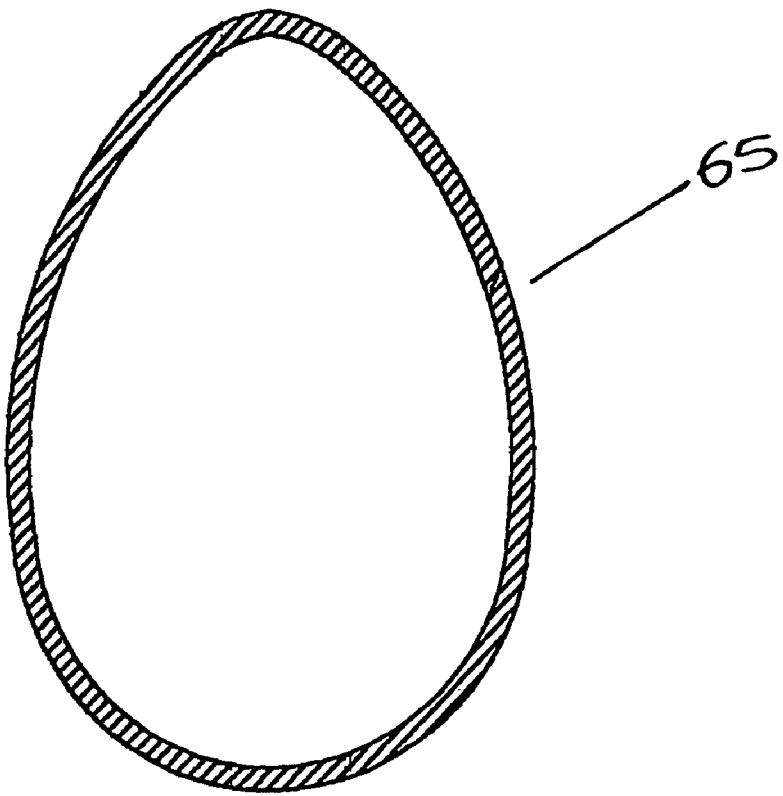
Figure 14:
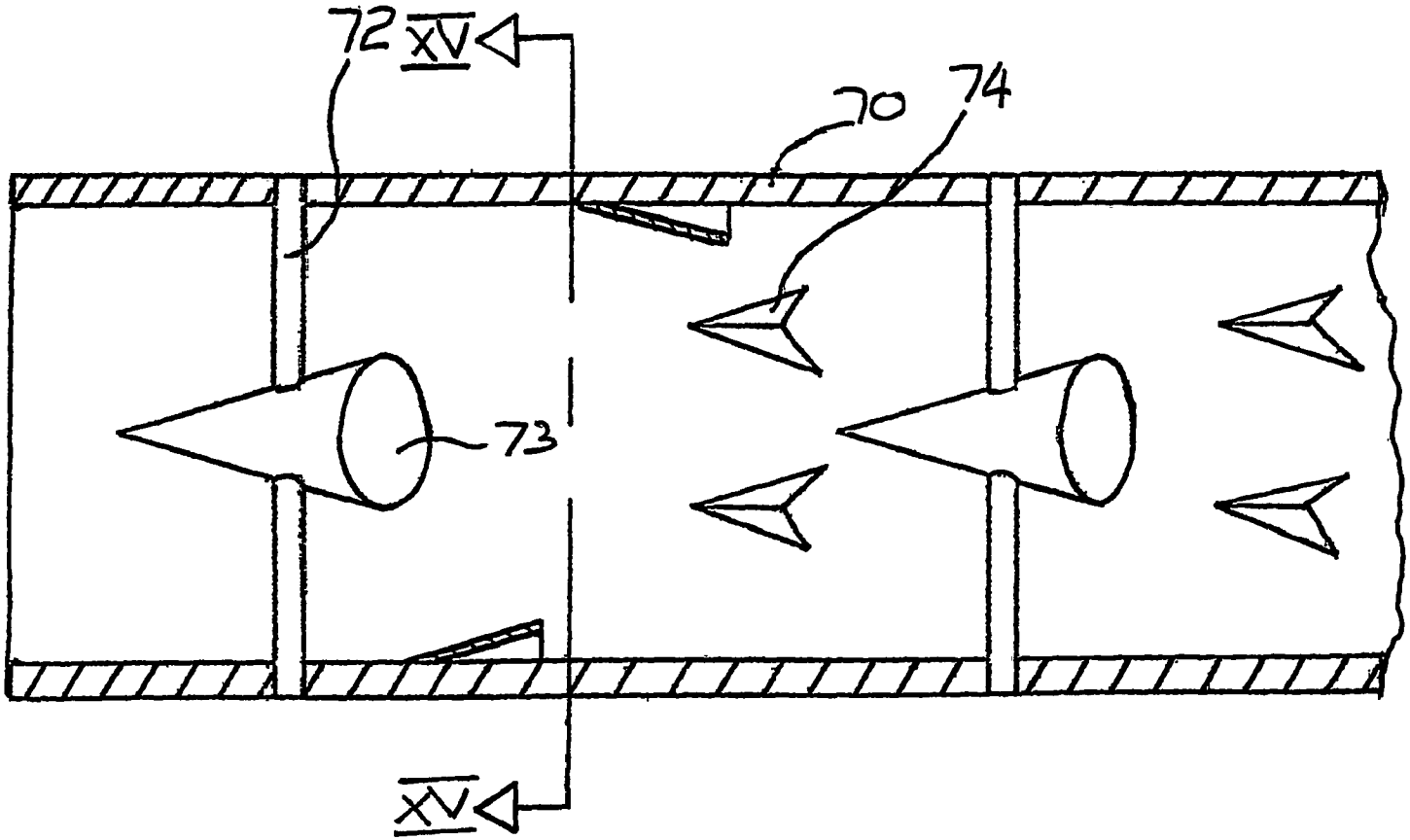
Figure 15:
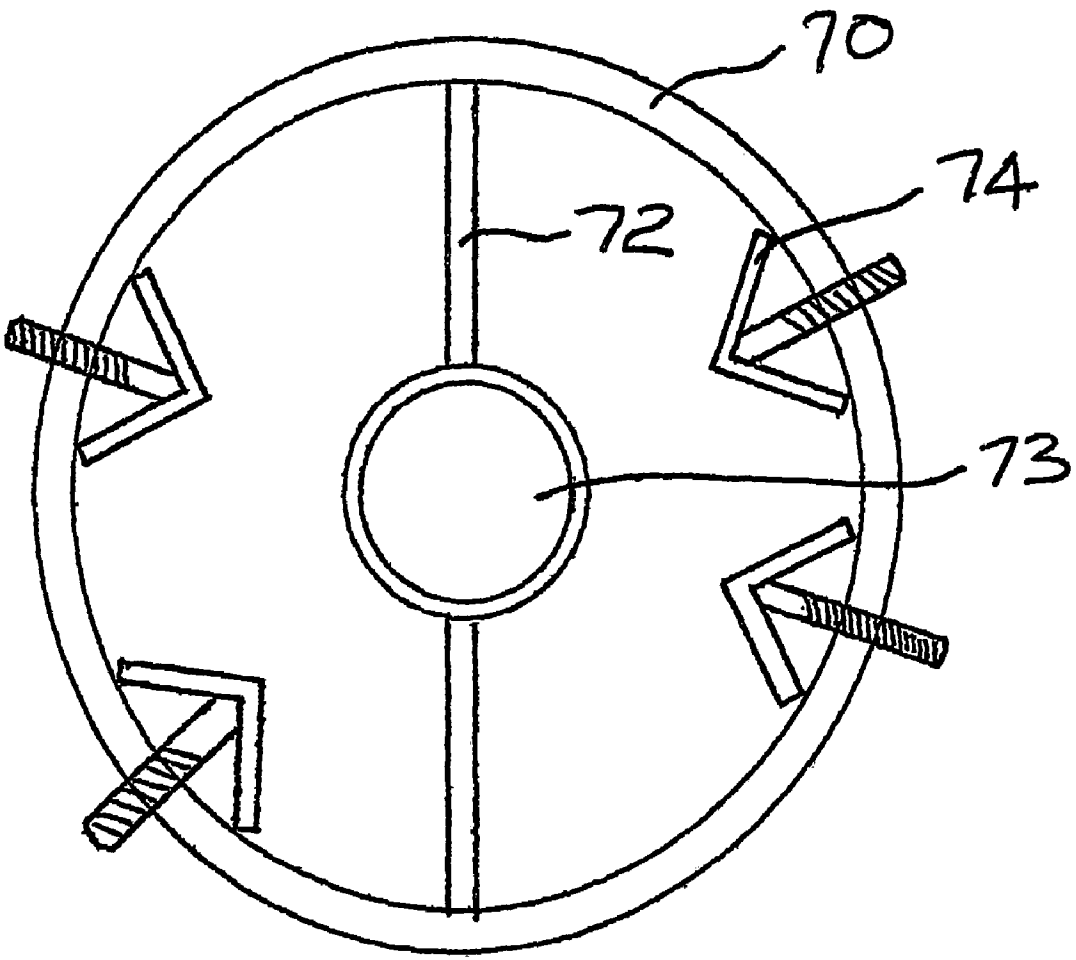
Figure 18:
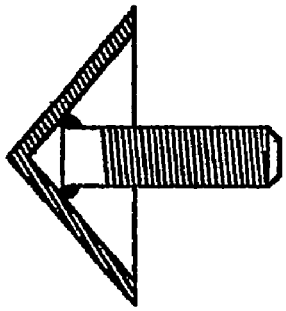
Figure 17:
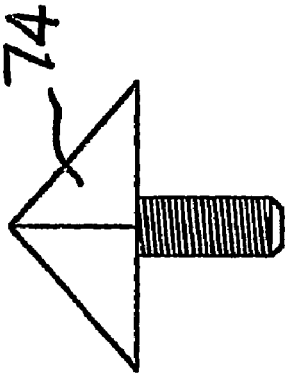
Figure 16:
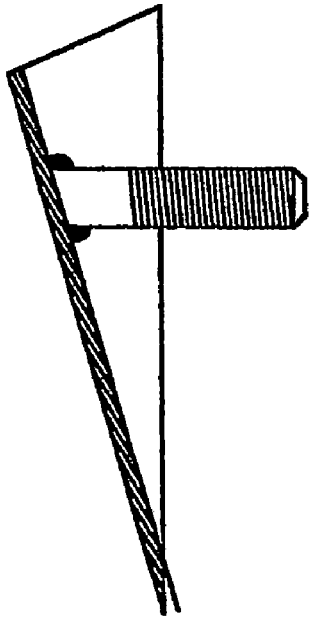
Figure 19:
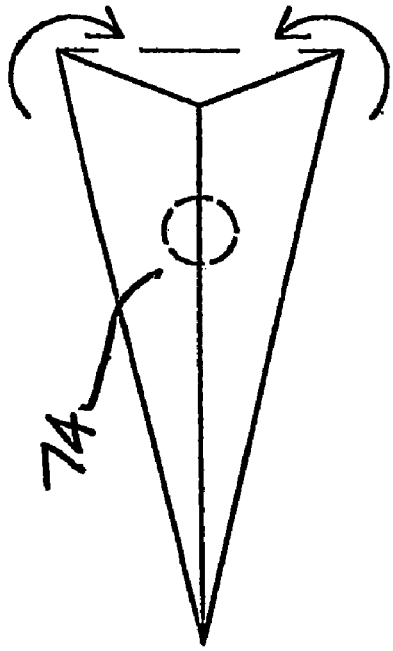

Referring now to FIG. 12, there is illustrated in section, an alternative construction of portion of the cyclone chamber 2, identified by the reference numeral 65, of generally ovaloid shape, which is used to form portion of the cyclone chamber 2. In FIG. 11, there is illustrated another construction of cylindrical section 66, again of ovaloid shape having crimping forming an arcuate indentation 67. It has been found that such a construction aids in forcing and maintaining the vortex as well as increasing the hydrosonic activity across the indent as illustrated by the arrow.

The indented egg cross section of the crimped ovaloid pipe, it is suggested, allows the water to curl inward on itself creating a longitudinal waveform. In addition, at a certain point, an evacuated cavity forms around the water itself so that it "sucks" away from the walls of the tube and does not actually contact them as it flows through. What happens is that there are no 100% homogeneous flows. The shape of the tubes encourages an organization of these varying density conditions into relative and coincident patterns—faster flowing moves to the outside and slower moves to the inside, just like different speed lanes on a highway, congestion disappears as increased order appears. However, with a fluid where these individual density zones are in contact, the faster movement will impart a "nudge" (by suction) on the slower to move faster. If resonance is engineered into this flow, the flow will eventually continually increase as a consequence of this factor to several times the speed of sound under maximum load generated at about 6–7000 rpm on an eight bladed impeller. Differential densities, separated into discrete speed zones, is what makes this vortexian flow work.

Referring to FIGS. 14 to 19 inclusive, there is illustrated an alternative construction of cylindrical portion 70, comprising a duct having suspended therein by bars 72, hollow cones 73. Further, there is mounted on the periphery of the duct 71, hollow prisms 74.

In use, the hollow cone 73 provides a vortex flow shedding device which causes a vortex-shedding-like back draft that separates suspended matter from the water. The hollow prisms 74 have the ability to separate the water and material therein apparently through expulsion determined by specific gravity. The hollow prism 74 and hollow cones 72 also effect boiling of the water by maintaining a vacuum within the respective interiors formed as the cyclone rushes past the entrance to either the cone 73 or prism 74.

In another embodiment (not shown) means are provided for increasing the vacuum within the prism. Ideally this is provided for by a vacuum pump. Depending on the consistency of the material in some embodiments, it is sometimes advantageous to place these devices after the criss-cross section following the sphere at the proximal end of the apparatus to assist the vortex flow shedding.

Figure 20:
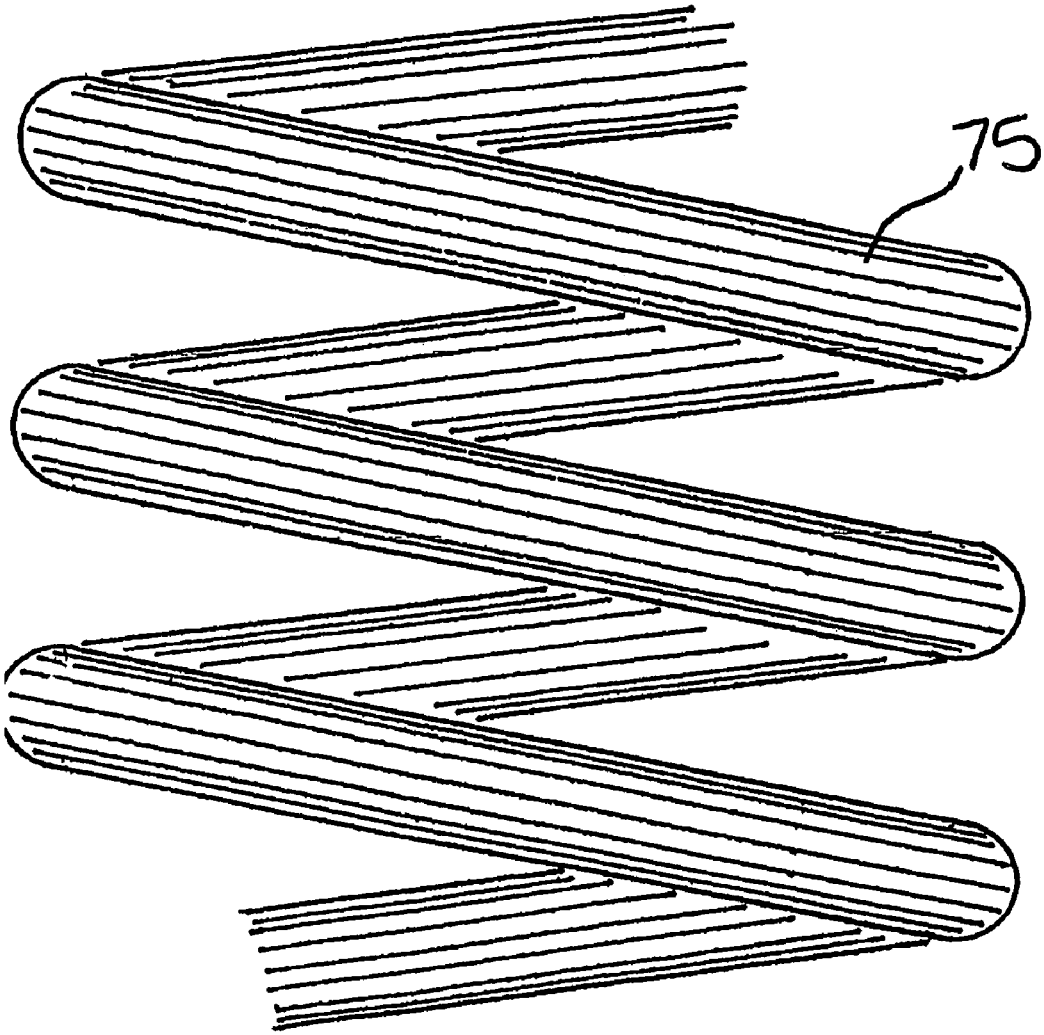
Figure 21:
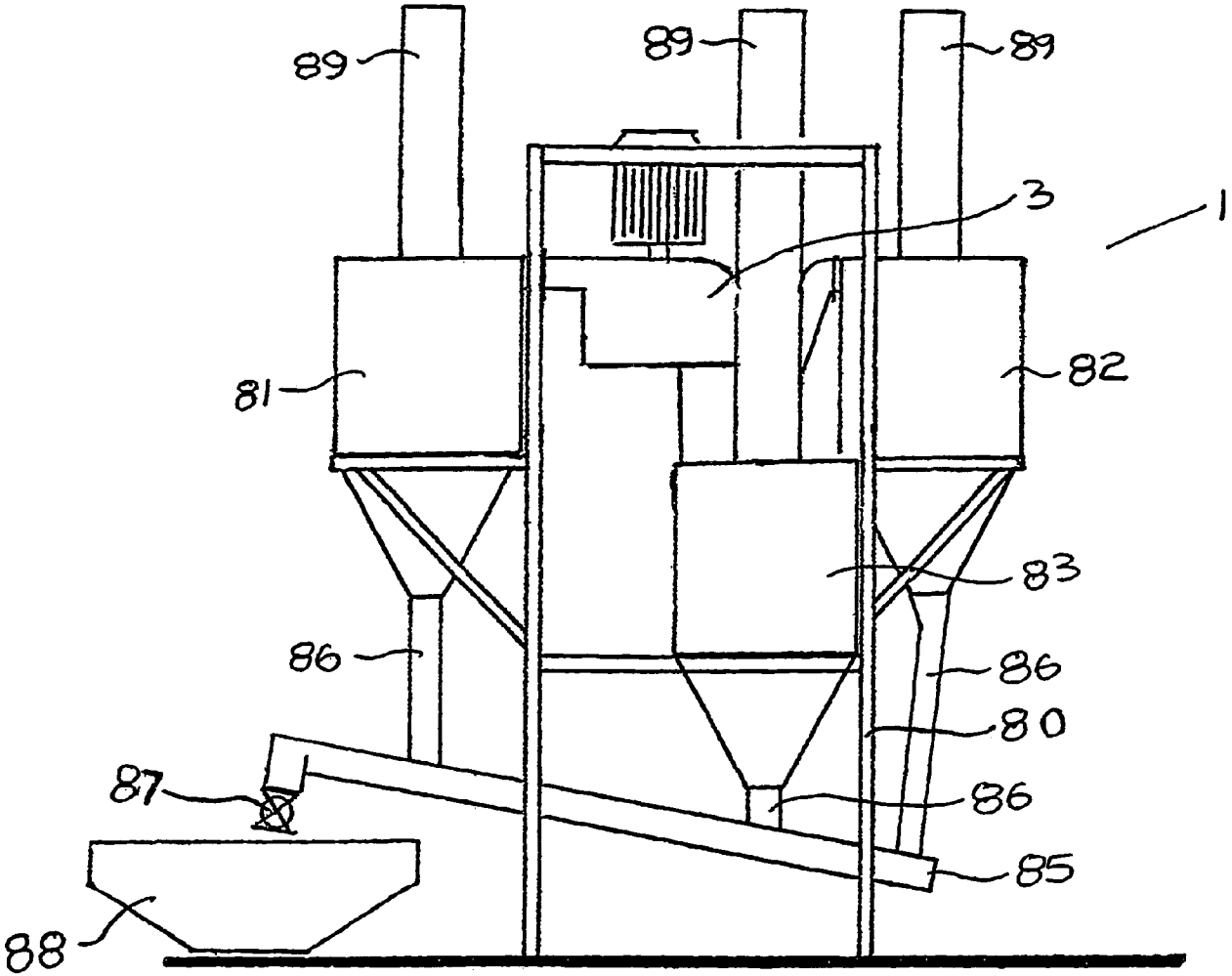
Figure 22:
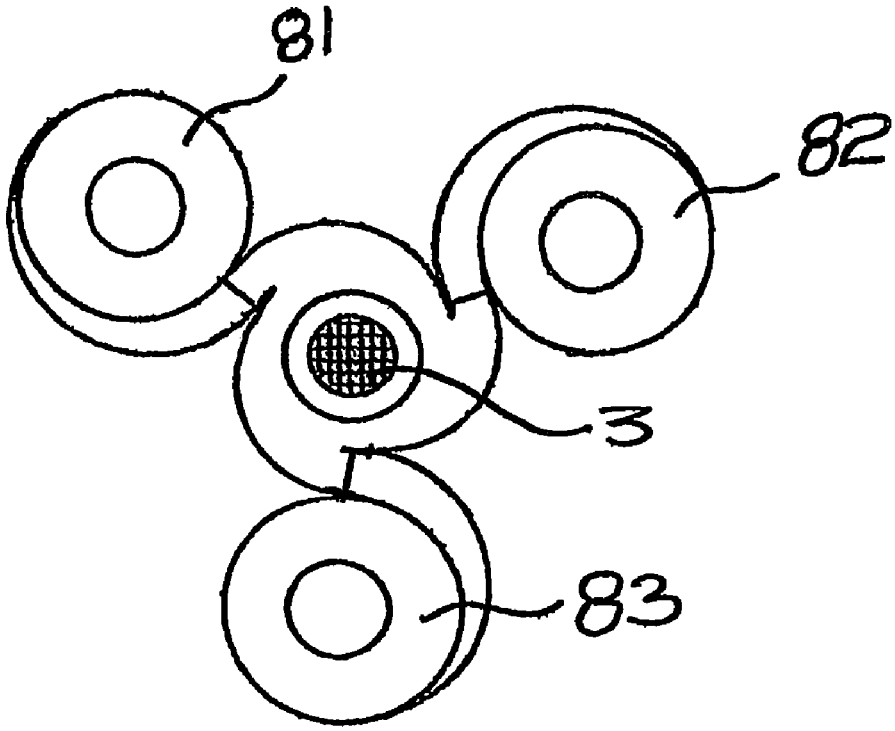

Referring to FIG. 20, there is illustrated a further construction of cylindrical section 75, which is simply a spirally wound tube and is preferably of one of the constructions illustrated in FIGS. 10 and 11. Thus, an ovaloid crimped surface is particularly advantageous, as illustrated. This duct, suppose, for example, it is of the shape illustrated in FIG. 10 or 11, can be twisted about itself, that is to say, about its own central axis also. Thus, for example, with the shapes, as illustrated in FIGS. 10 and 11 and specifically FIG. 11, the crimping or arcuate indentation could form a spiral about the pipe as well. Apparently, this spiralling appears to reduce friction considerably and thus reduces the power requirements.

Figure 23:
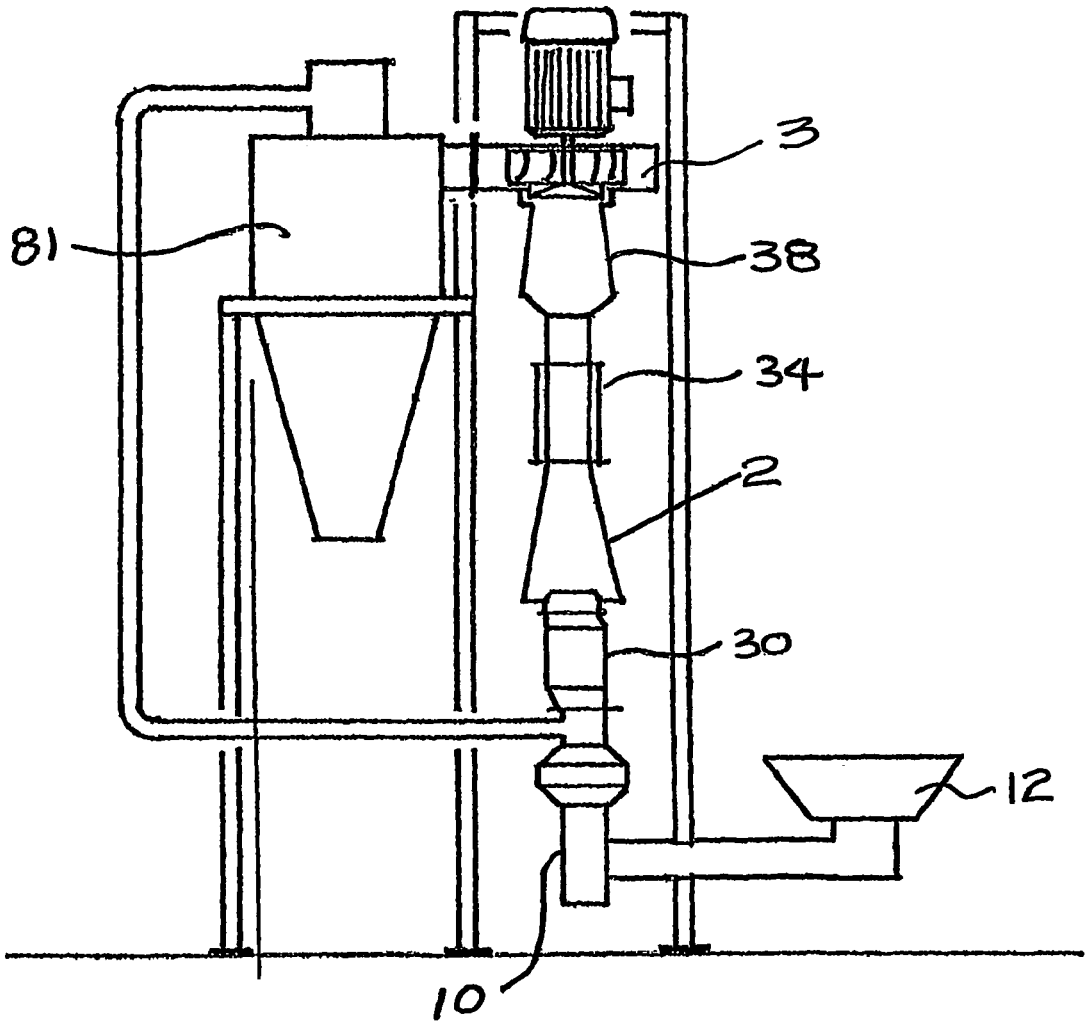
Figure 24:
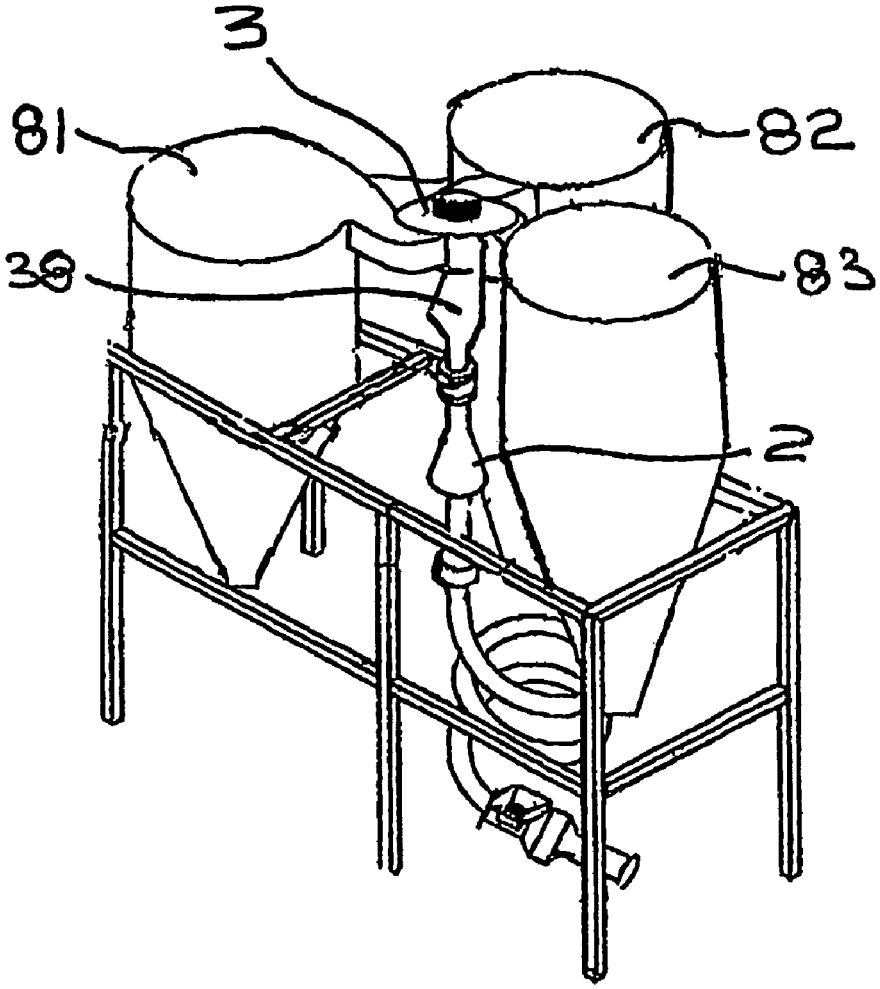

Heretofore, the description has related entirely to the cyclone chamber and not, strictly speaking, a full assembly or apparatus. Referring to FIGS. 21 to 24, there is illustrated what is in effect the full assembly of an apparatus for the drying of various materials and is indicated generally by the reference numeral 1. The drying apparatus 1 comprises a support framework 80 on which is mounted three discharge cyclone chambers 81, 82, 83 and a vertically arranged cyclone chamber 2 which is for clarity omitted from FIG. 21. Similarly, the discharge cyclone chambers 82 and 83 are omitted from FIG. 23. The dewatering cyclone chamber 2 is vertically arranged as illustrated in FIGS. 23 and 24 and comprises a mix of the various parts illustrated in the previous drawings. FIG. 24 shows a slightly different arrangement The fan 3 feeds the discharge cyclones 81, 82, 83. The discharge cyclone chambers 81, 82, 83 feed a collection conveyor 85 via discharge chutes 86. The conveyor 85 feeds a collection hopper 88 via rotary seal 87. The cyclones 81, 82 and 83 also have air vents 89. It is also envisaged that in certain embodiments the apparatus may be capable of being transported, for example, between different sites.

Figure 25:
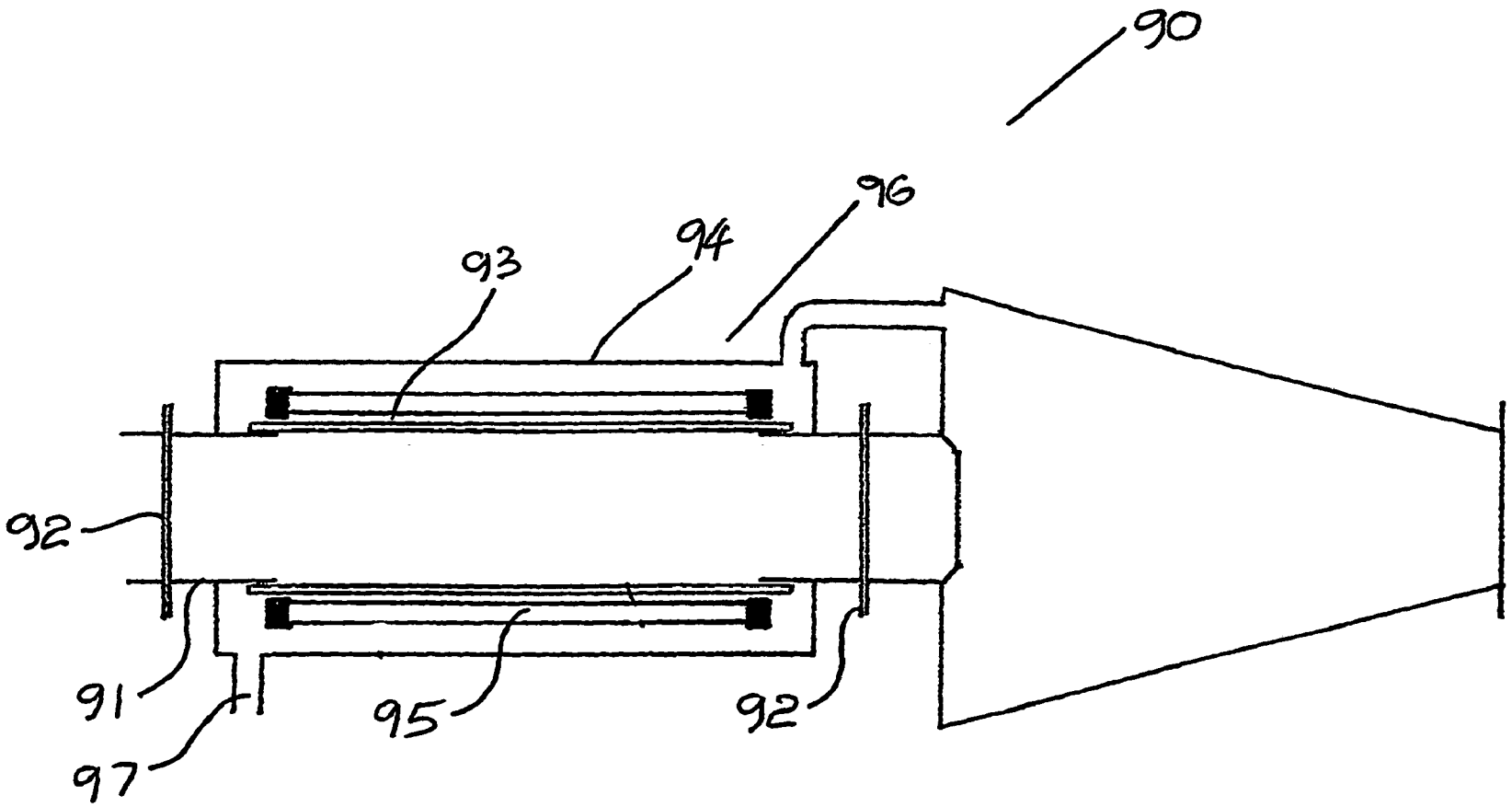

Referring to FIG. 25, there is illustrated a further construction of the apparatus, again indicated generally by the reference numeral 1, in which now the cyclone chamber is horizontally arranged.

The cyclones 81, 82, 83 may also incorporate fans. The effect of the cyclones is to ensure that there is a low pressure environment so that when the fan 3 discharges, there will not be water reformation that could occur.

It is envisaged that in certain embodiments the apparatus may be capable of being transported, for example, between different sites.

In this particular embodiment, it has been found that there is additional drying in that the fully dried and, very often, powdered material is quickly removed from contact with any moisture and thus, condensation does not occur. Further, a problem that had been noticed with the fan was that, due to the high pressure involved, a certain amount of vapor was reformed into free water and by using three discharge cyclones, it appears that there is a reduction in pressure which prevents reformation of water. It is thus a feature of certain embodiments that a negative pressure is maintained throughout the apparatus and in particular at discharge and within the impeller casing 3*a*.

Figure 26:
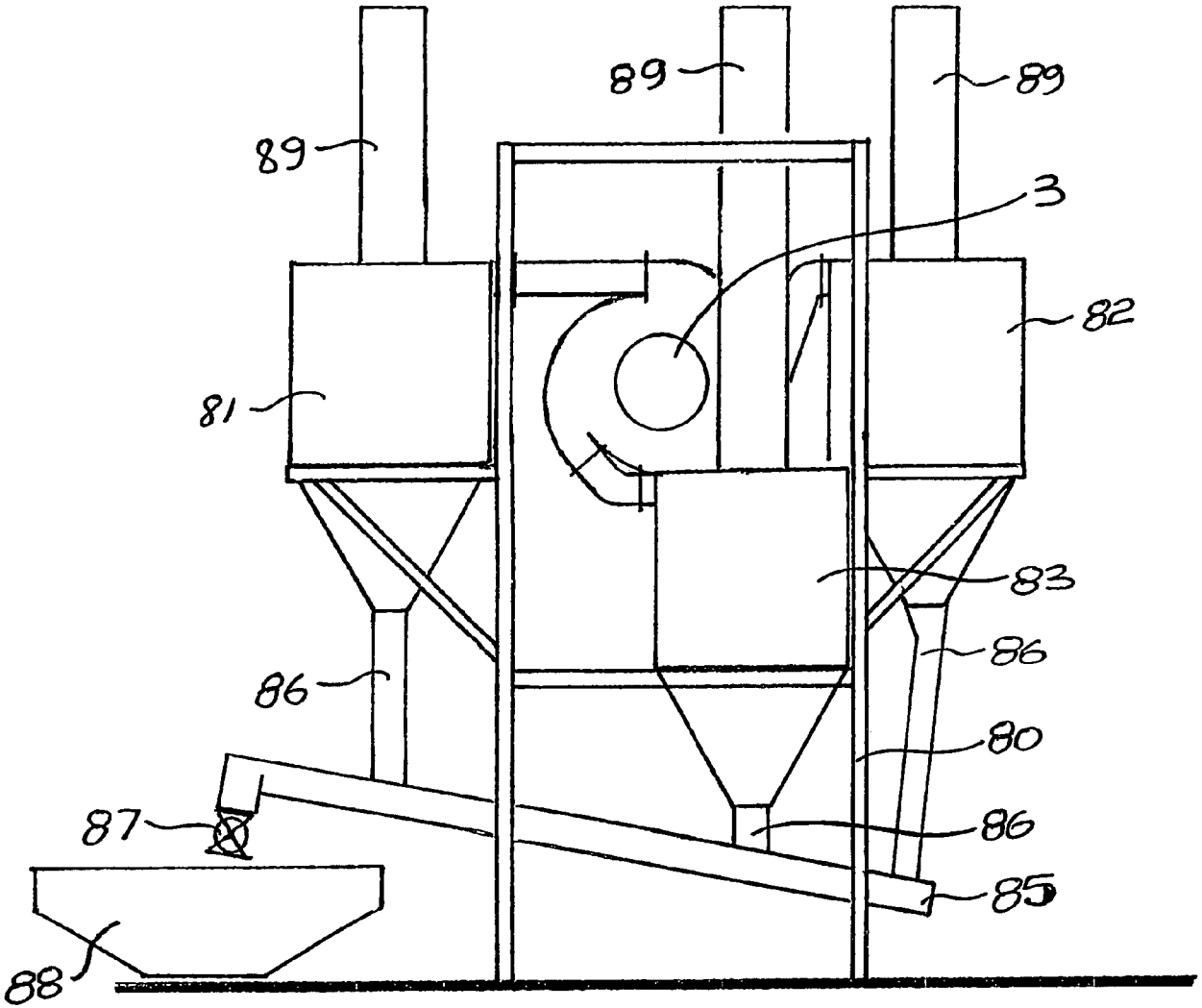

Referring to FIG. 26, there is illustrated an ionization device, indicated generally by the reference numeral 90, feeding a frusto-conical portion. The ionization device 90 effectively forms a cylindrical section in the form of a cylindrical duct 91 with end flanges 92 and an elongate inner cylindrical sleeve 93 made from lead crystal glass housed within an outer sleeve 94. Between the sleeves 93 and 94 are a plurality of UV lamps 95. The sleeve 93 has an air inlet 96 and an air outlet 97.

In many embodiments of the invention, the ionization device 90 can be used to facilitate the serialization and deodorizing of feedstock air. It is believed that it destabilizes and consequently assists in the dissociation of water molecules forming high energy radicals. It is not known exactly how it operates but it appears very much to operate to condition, very well, the air used in the present invention.

Figure 27:
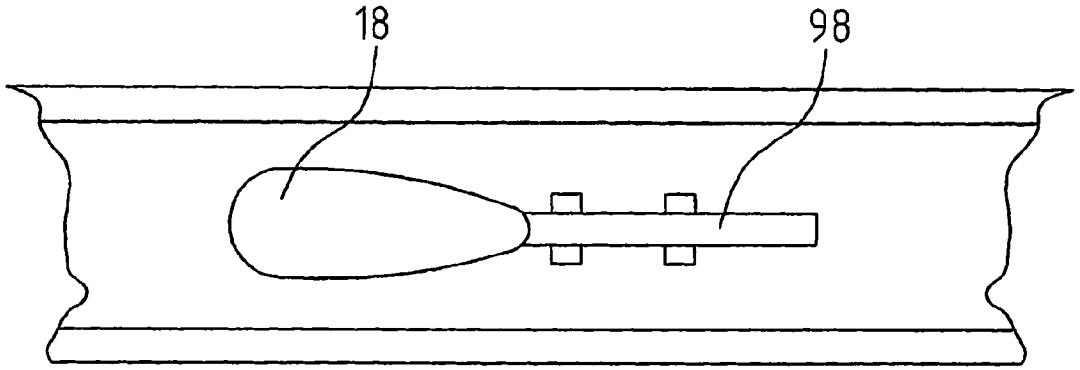
FIG. 27 is a sectional view of portion of the cyclone chamber according to the invention.

Referring to FIG. 27, there is illustrated another construction of egg, again identified by the reference numeral 18, attached to which is an ozone plasma generator 98. The ozone plasma generator 98 incorporates slipping surface discharges which involves a high current pulse which enables the formation of a plasma layer near their surfaces. The slipping surface discharges generate toroldal convergent shock waves, metallic plasma in a capillary plasma source, strong UV radiation, ozone and a range of free radicals. SSD works in air and liquids and affects destruction of microorganisms and degradation of organics by intensive UV irradiation, acoustic waves, shock waves and photochemical reactions. It thus differs somewhat from other UV liquid treatment systems.

Figure 28:
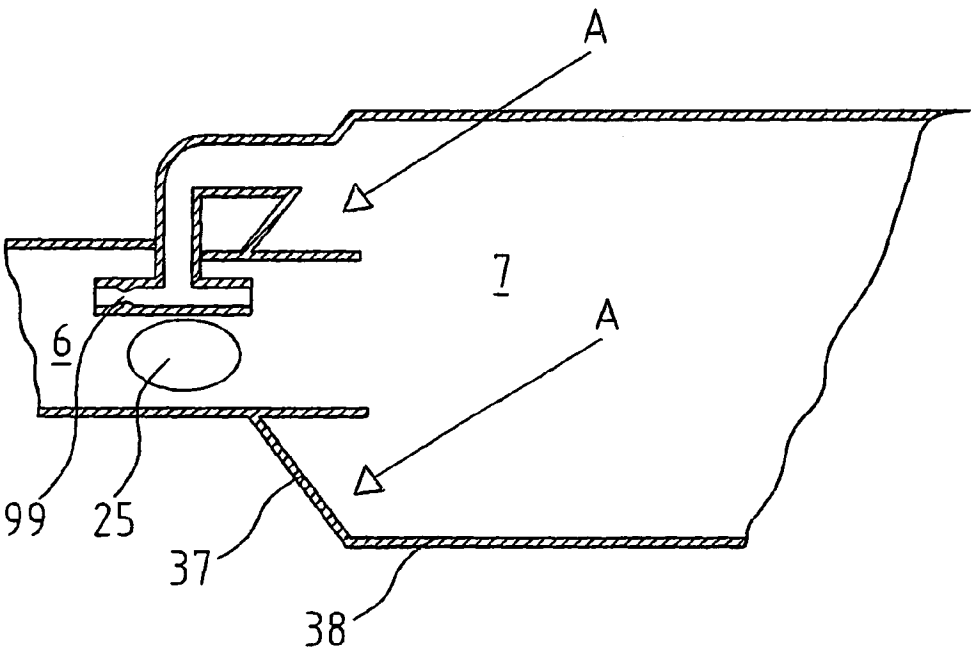
FIG. 28 is a sectional view along portion of another section of the cyclone chamber.

FIG. 28 illustrates a venturi 99 mounted in a vortex flow forming station where the vortex flow forming station 6 is about to connect into a vortex flow shedding station 7. Normally, an egg 25 is mounted therein. When the vortex flow discharges into the vortex flow shedding station 7, a vacuum is generated behind the exit from the vortex flow forming station 6 at the portion identified by the arrow A. Thus, there is a vacuum formed which is further increased by the use of the venturi 99.

Figure 29:
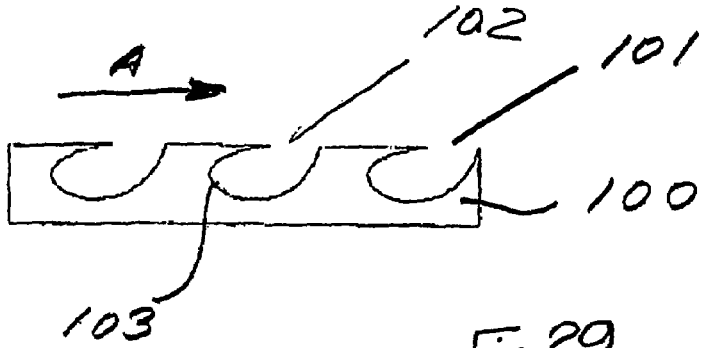
FIG. 29 is an end view of a wear plate according to the invention.

FIG. 29 shows another construction of wall 100 that may be used to form any of the cyclone chambers 2 or the fan blades 5, which wall comprises a series of recesses, identified by the reference numeral 101. Each recess 101 has an open mouth, indicated generally by the reference numeral 102, which open mouth is downstream of a portion 103 of the recess and thus air travelling in the direction of the arrow A will cause cavitation within the recess 101.

Figure 30:
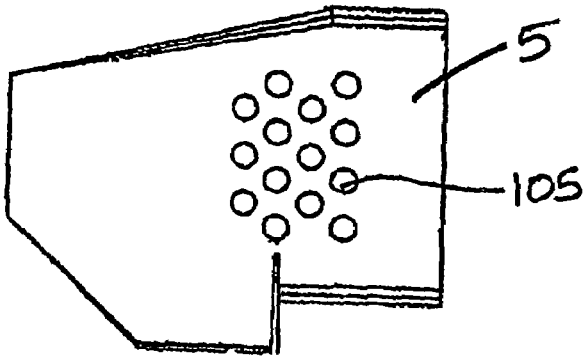
FIG. 30 is a front view of a fan blade.
Figure 31:
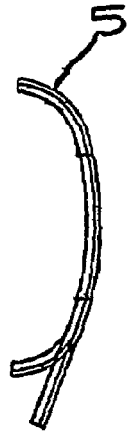
FIG. 31 is a side view of the fan blade.

Referring to FIGS. 30 and 31, there is illustrated a fan blade 5 having perforations 105. It will be appreciated that the fan 5 could also be constructed of material similar to that illustrated in FIG. 29 or could incorporate perforated wear plates. It will be appreciated that vortex flow forming vanes may be provided in other portions of the interior of the cyclone chamber, other than as only illustrated at inlet. Further, vanes or vortex flow forming devices mounted in, as it were, contra flow to the air can be used as vortex shedding devices. It will also be appreciated that any vortex flow forming devices can comprise a body of reducing cross section from its upstream end to its downstream end.

Figure 32:
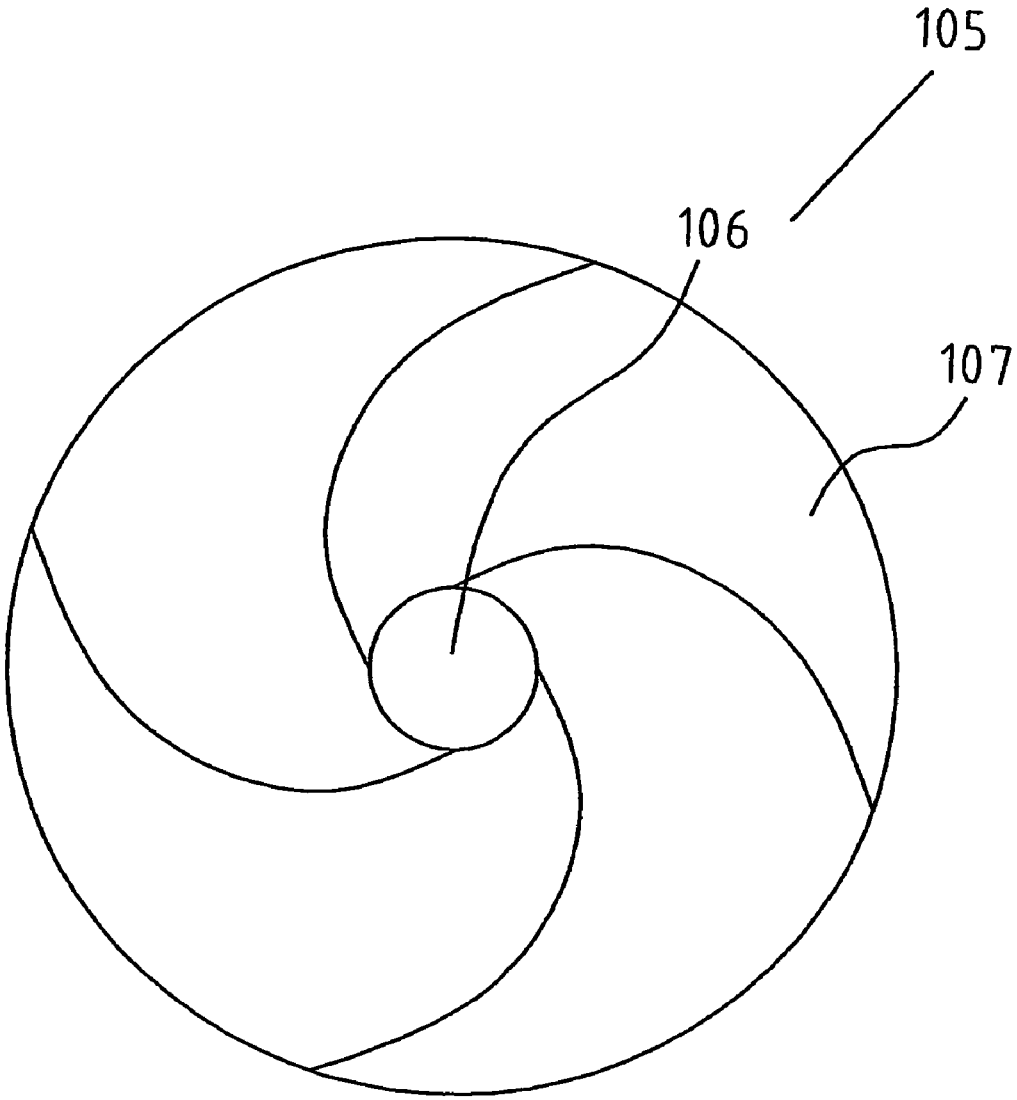
FIG. 32 is an end view of an alternative construction of vortex flow forming device according to the invention.
Figure 33:
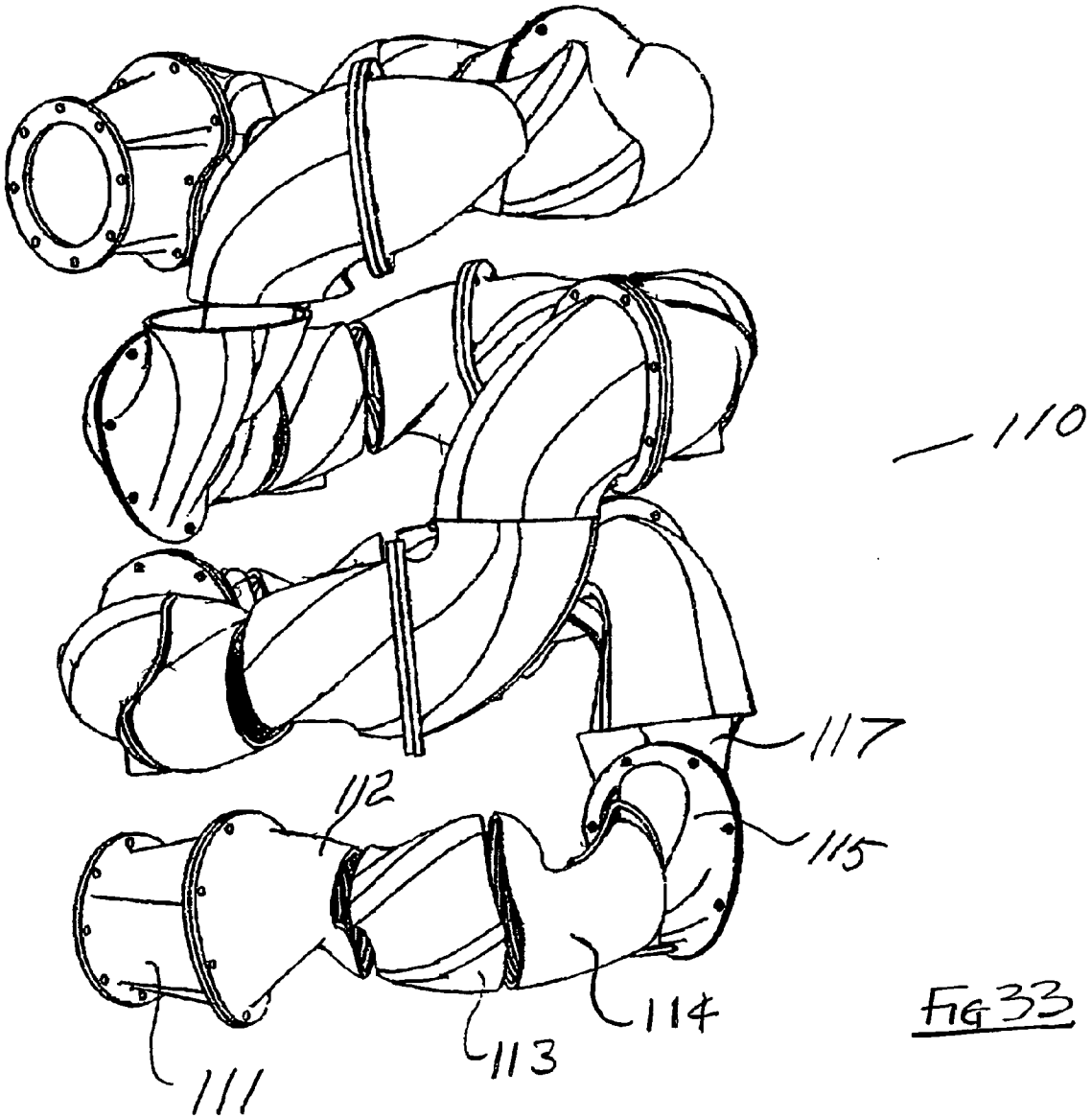
FIG. 33 is a perspective view of a twister pipe forming a cyclone chamber according to the invention, FIGS. 34 to 39 inclusive, are perspective views of portions of the twister pipe of FIG. 33.
Figure 34:
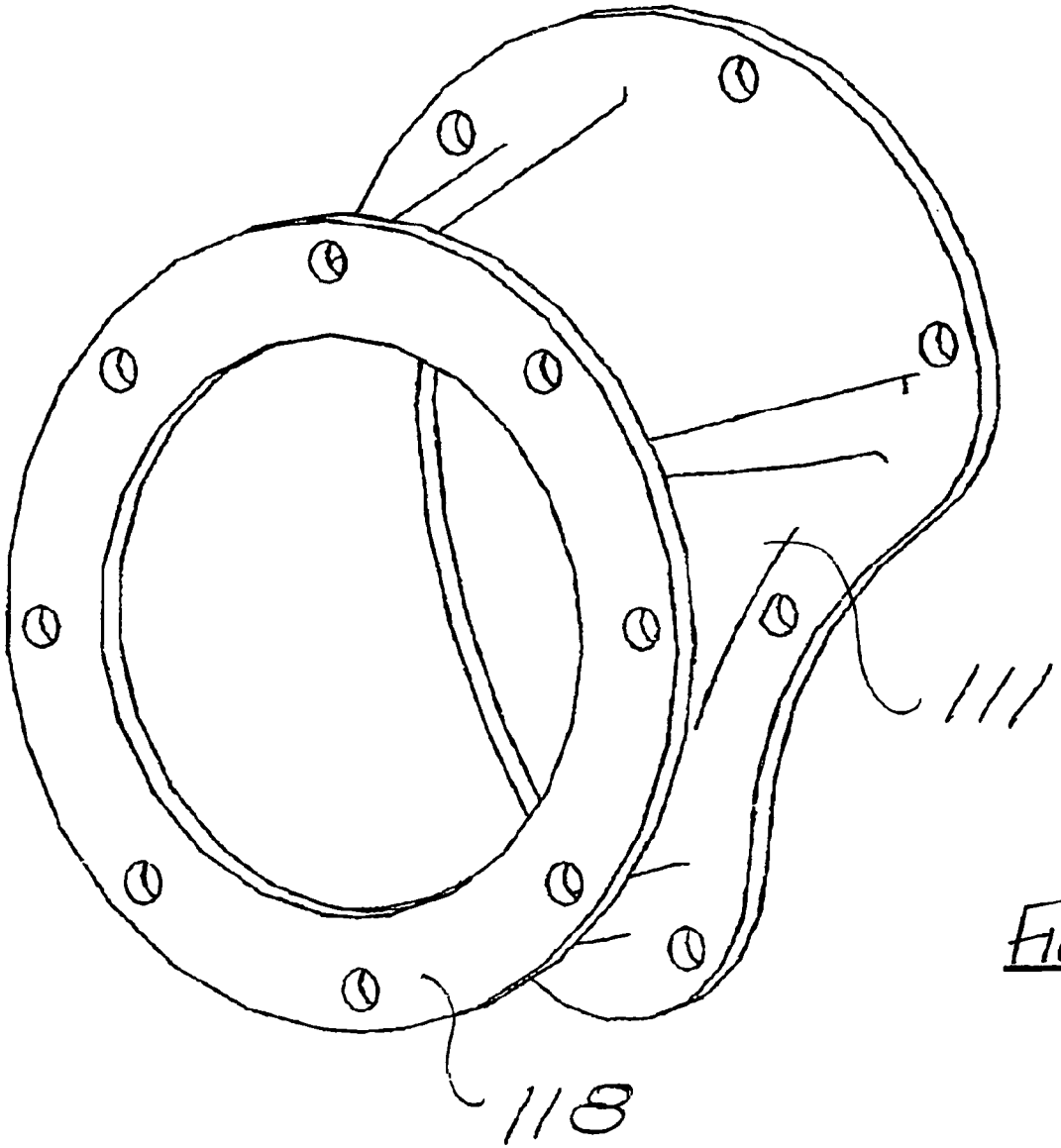
Figure 35:
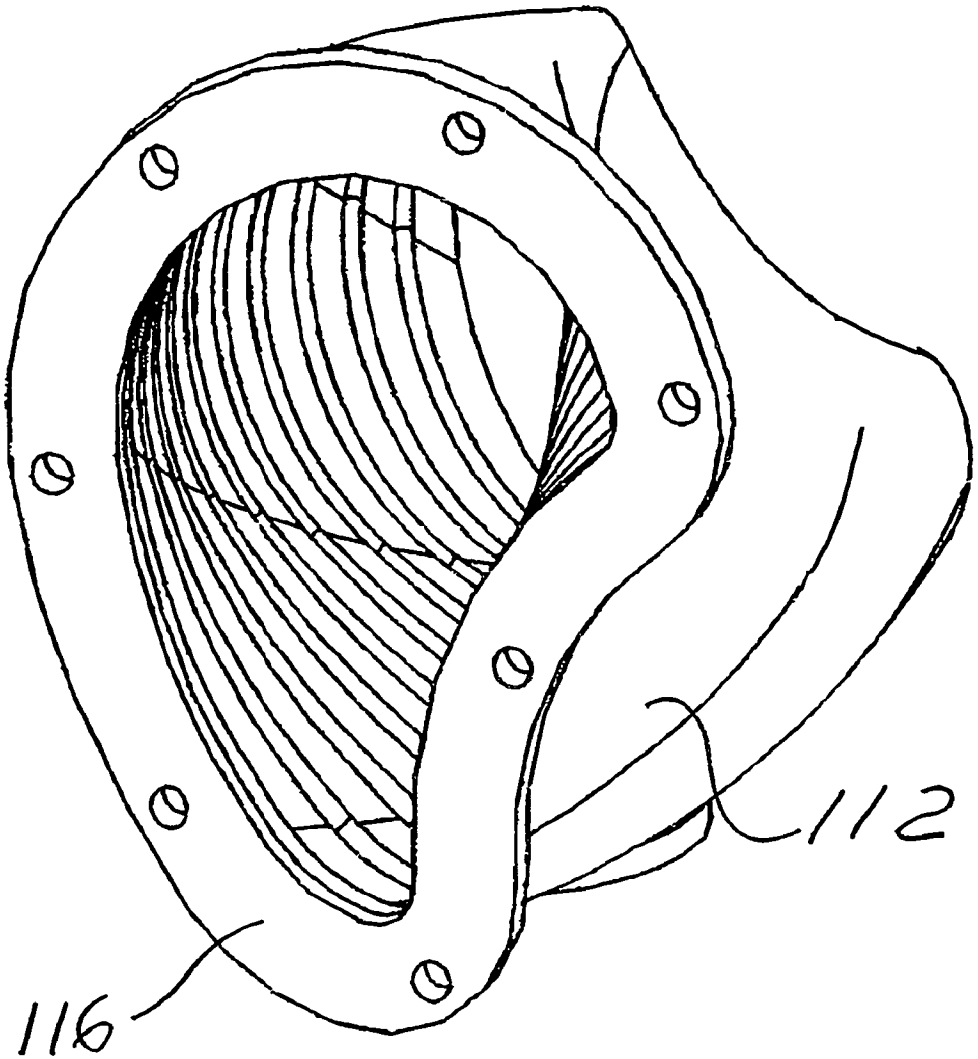
Figure 36:
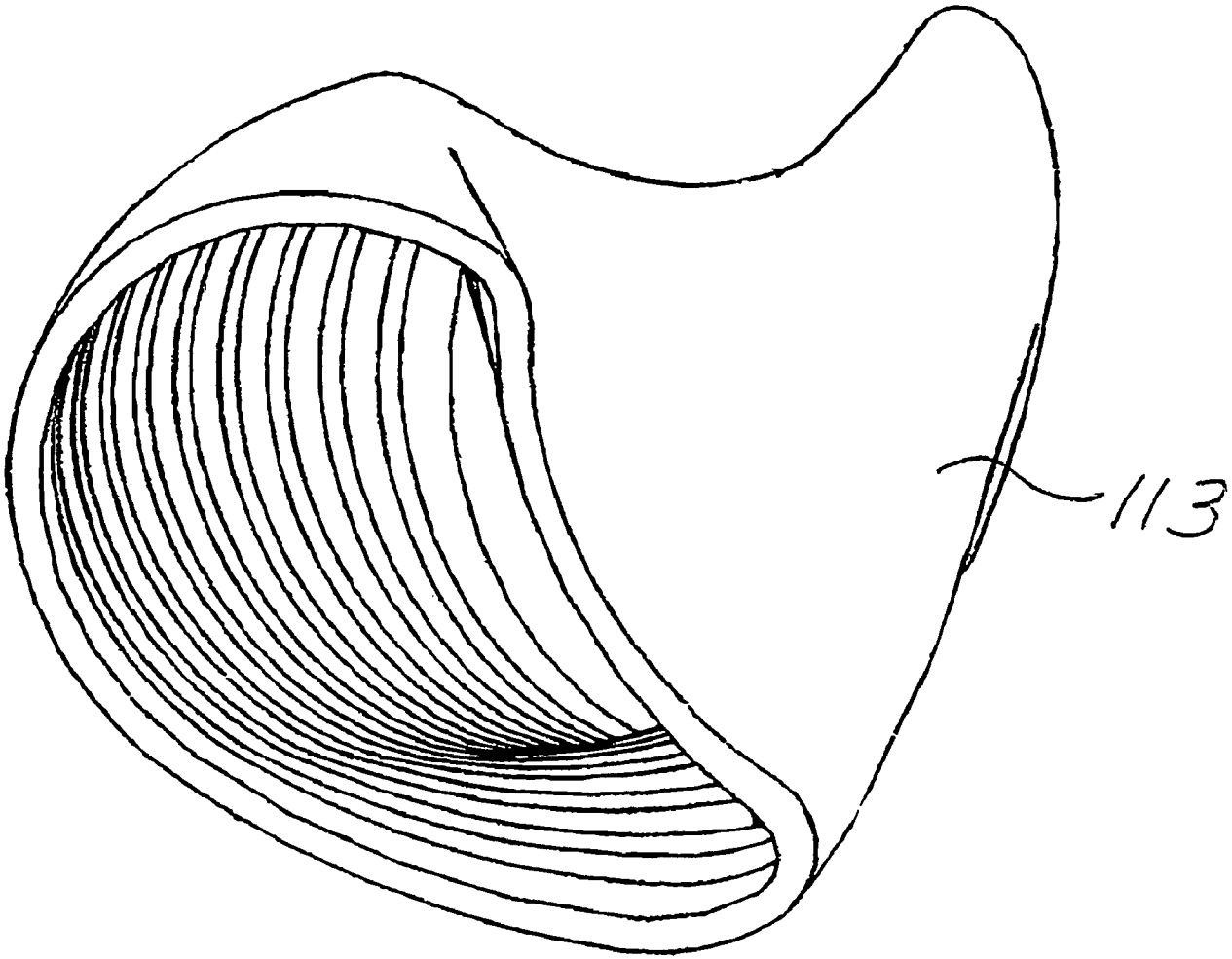
Figure 37:
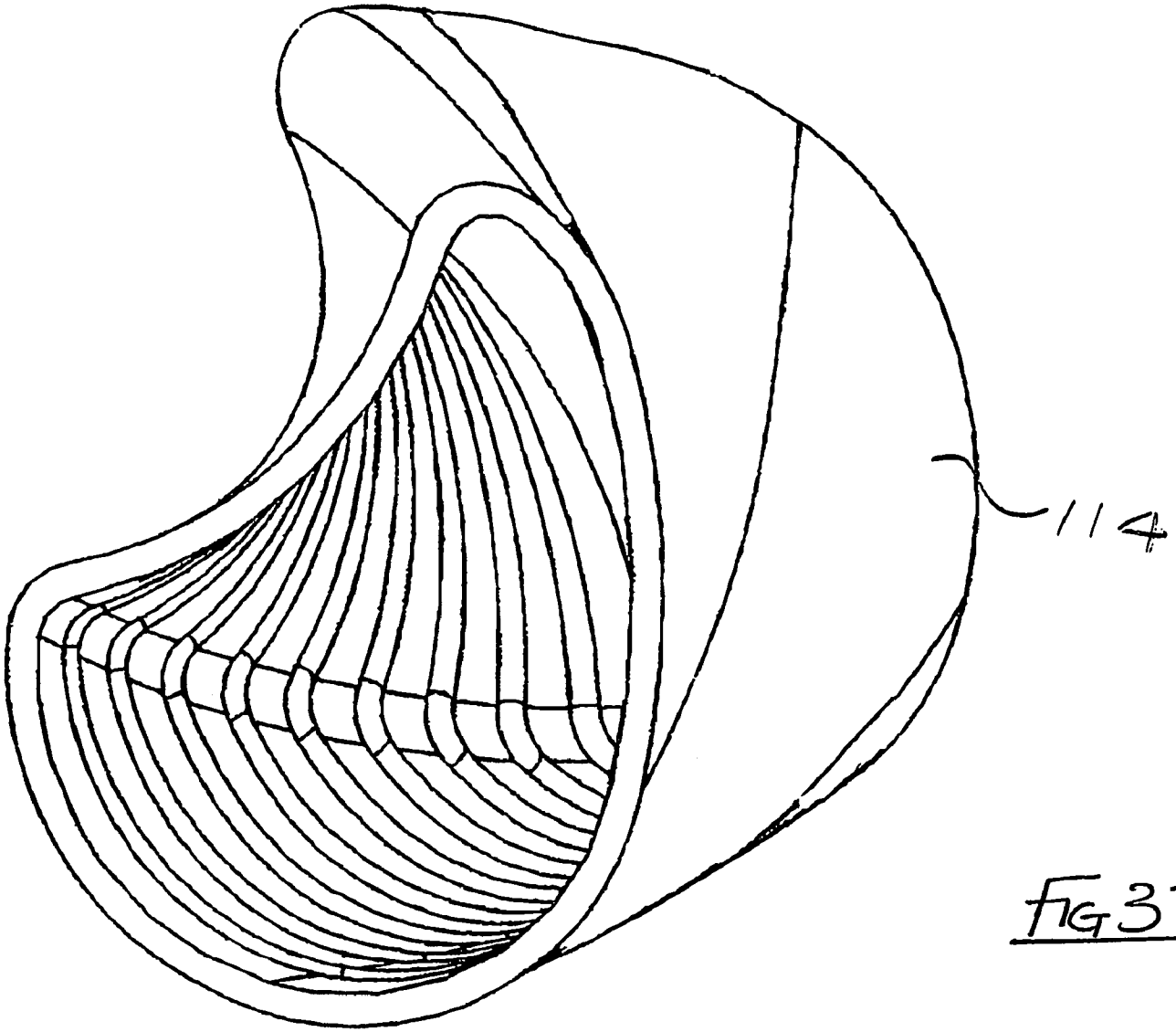
Figure 38:
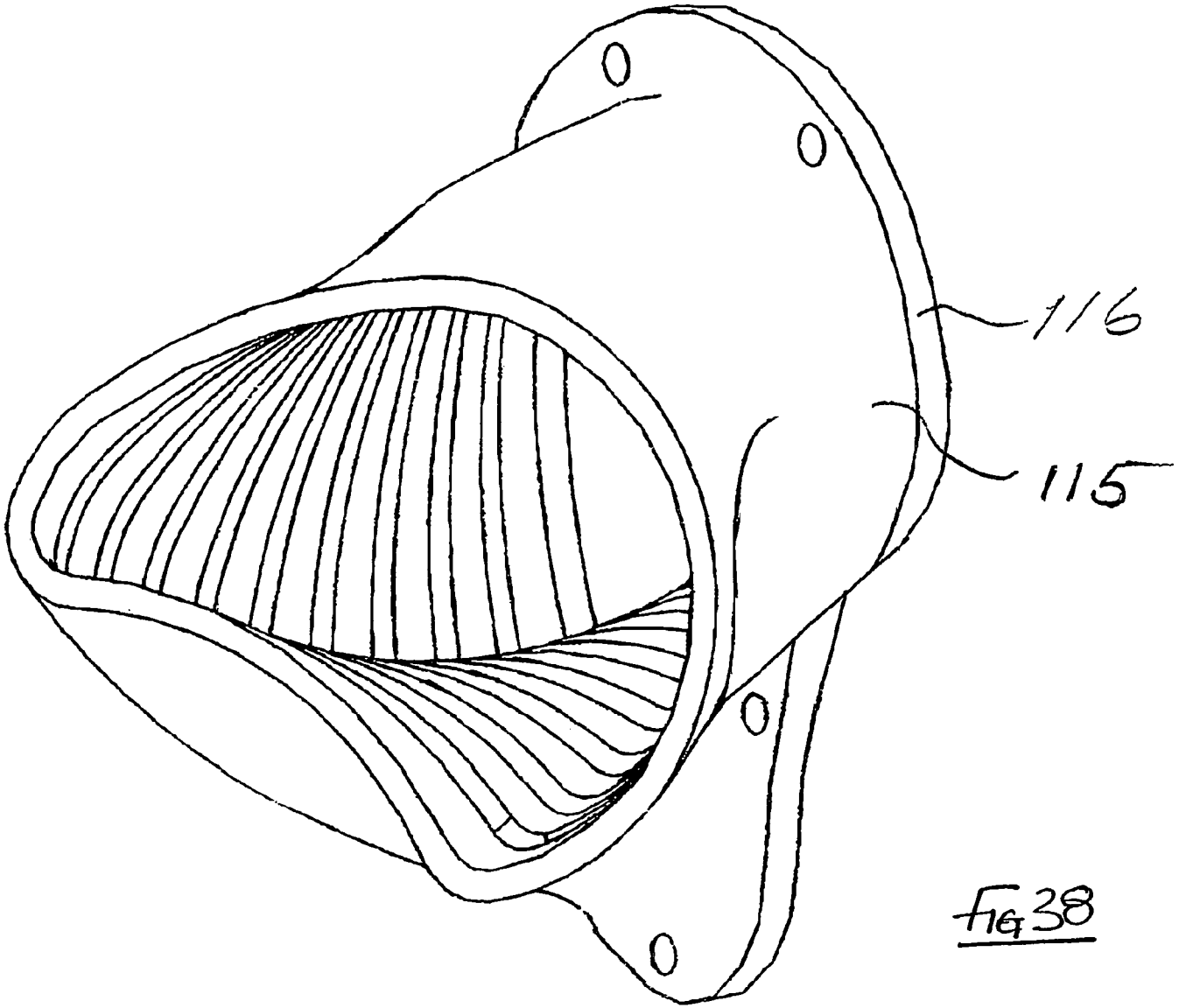
Figure 39:
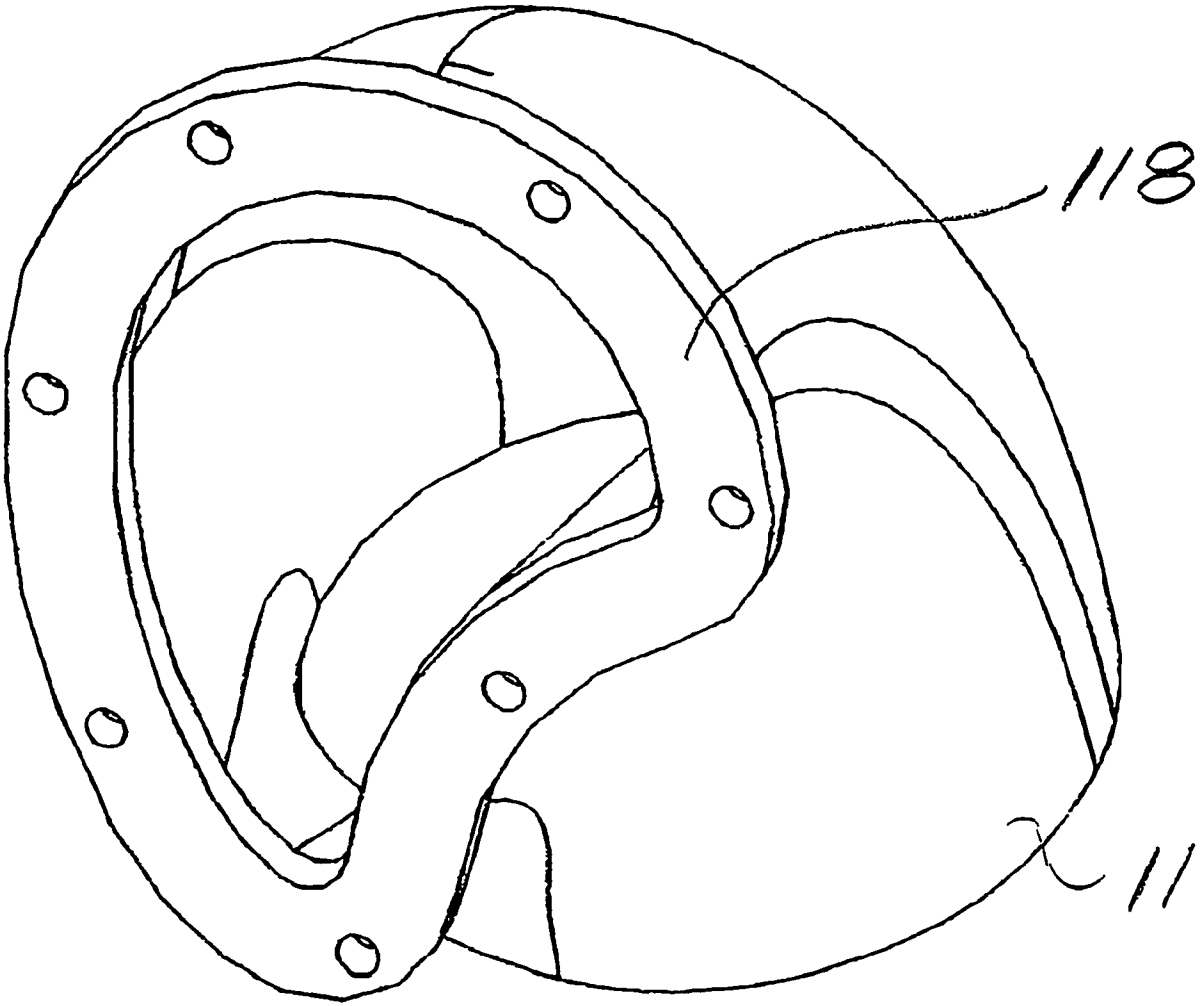

FIG. 32 shows an end view of another vortex flow forming device, indicated generally by the reference numeral 105, which comprises a central core 106 around which are mounted vanes 107, each of which is twisted along its length to impart vortex flow.

Referring now to FIGS. 33 to 39 inclusive, there is illustrated a twister pipe 110 of particularly useful construction for forming a cyclone chamber 2. The twister pipe 110 comprises various sections, only some of which are identified, namely, a twister pipe inlet transition 111, a twister pipe section 112, a twister pipe section 113. The twister pipe sections 112, 113, 114 and 115 terminate in flanges 116. There is further provided a transition elbow 117 which has a flange 118. The twister pipe inlet transition 111 also has a flange 118. The flanges 118 are connected to the flanges 116 to provide portion of the twister tube 110.

Figure 40:
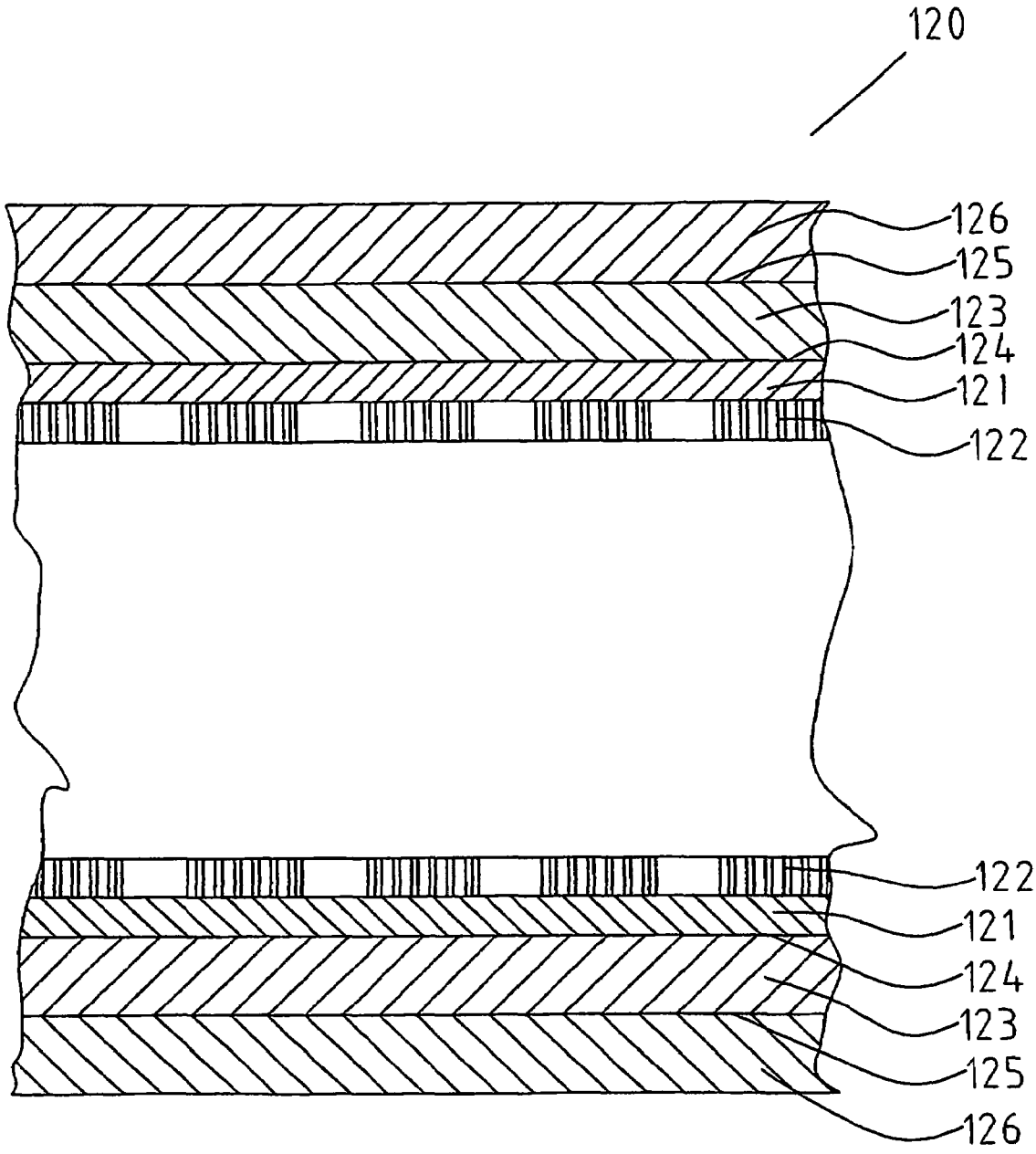
FIG. 40 is a sectional view of portion of a cyclone chamber according to the invention.

Referring to FIG. 40, there is illustrated an alternative construction of assembly 120 forming portion of the cyclone chamber 2 comprising a pipe 121 having an inner liner plate 122, both of non-ferrous construction such as stainless steel, magnetic walls 124 and 125. A final outer sleeve 126 is mounted around the assembly which sleeve 126 is of a ferrous material. Generally, the magnetic sleeve 123 will be magnetized so that its inner surface forms a negative pole.

In use, the wall 124 of the magnetic sleeve 123 is magnetized to have a polarity opposite to that of the wall 125.

For vortex shedding, as well as using a sphere 15, the sphere 15 may have an open upstream facing mouth or an open downstream facing mouth.

As explained above, the advantage of the present invention is the way in which relatively tight and high-energy vortices are formed. This effectively achieves, in milliseconds, what would previously have taken some considerable length of time. Again, it must be appreciated that the apparatus can be used not only to dry materials but also to pulverize them and to sterilize material and further, to bind heavy metals into safe complexes and effectively, detoxifying materials. It appears that this is assisted by an electro chemical process that can be achieved by the use of electromotively opposing metals which allow the valency and buoyancy tendencies of the heavy metals to be utilized.

The particular type of apparatus may be changed, depending on whether the apparatus is being used to de-water material or being used to either de-water and mill, for example, grains which are separated into flour which after being dried and disinfected, enters the baghouse and husks which enter the cyclone. It has been found that simple arrangements of frusto-conical sections of decreasing cross-section are better for de-watering, while increasing frusto-conical sections, followed possibly by a constant diameter section and then a further decreasing in diameter frusto-conical section often worked best for grinding and milling in that larger areas to allow the particulate matter to impinge against the side walls of the device are provided.

It has also been found that manufacturing the surfaces in such a way as to contain indentations and micro-pockets has certain major advantages. Apparently, as air and solid material rush past, the indentations cause increased turbulence creating what is believed to be a double helix-like peripheral centrifugal vortex which adds to the physical commutation of solid material and subsequent release of water contained within the material. Also, it is believed that the indentations and micro-pockets cause cavitation (hydrosonics). Because the passage through the cyclone is at relatively high speeds, as the material is carried passed these indentations, areas of low pressure are, we believe, created within the indentations and micro-pockets. This causes any residual water in the particles, firstly to expand and further break-up the particles, and secondly to boil off, vaporize or disassociate.

There appears to be many phenomena happening within the cyclone chamber and within the fan. Firstly, within the cyclone chamber, as explained, there appears to be what is effectively an inner centripetal action and an outer centrifugal action taking place. Also, it has been found that the perforated liners, or effectively indented liners, appear to greatly assist in de-watering. It has also been found that some of the eggs used appear to act as a vortex shredder and then a type of splattering device which separates the free water while creating a centripetal-like flow. Further, it is suggested that the guide vanes an the eggs and on portions of the device greatly facilitate in the production of concentrated vortices. The vanes on the egg induce the egg into becoming an implosive in-winding vortex concentrator, concentrating water anomaly, squeezing out free radicals which disassociate and gassify the water, as well as creating a vacuum in which water boils. Additionally, the vanes can create an explosive out-winding vortex which will shed and separate the water from the matter.

Our experiments to date show that the inner vortex is denser and containing (ions magnetically surcharged up to theoretically 96% of the formative energy of the vortex; travelling faster along the positive electric longitudinal axis with a higher rotational velocity exceeding the speed of sound than what appears to be an outer counter-flowing and braking centrifugal vortex containing theoretically as little as 4% of the formative energy lost in producing a theoretical recoil velocity resistance of up to 5000 m/sec to the centripetal vortex in the form of negative magnetic fields which we believe, is responsible for the dramatic reduction in energy requirements from the norm to evaporate water. There appears as there is expected to be, a vacuum formed between the two separate vortices, which themselves are obeying a generalization of Newtons law that forces can be created in pairs only and any active force will have spatial and chronal, equal and opposite reactive forces. Since Force equals Mass times Acceleration, the force on each of the vortices operating at theoretical maximum load driven by an impeller being driven close to 6000 rpm is generating exponentially more energy than that which is normally calculated in turbines from water failing in a gravity free fall and linear pressure as in hydraulics. It can be understood how the inventor felt that the workload generated by the turbulent 4% energy vortex in its efforts to achieve equal energy to the 96% energy vortex may well be enough to produce the exceptional phenomena demonstrated by this apparatus if the conditions generating this effect could be provided. Mathematics for demonstrating this phenomena may be provided once the new quad-double arithmatic packages become available and/or the parallelization of thermal Lattice Boltzman Codes for two fluid systems once the simulation for the horizontal 2 species turbulence with double vortex layers can be supplied.

It is assumed that the optimum Speed is not a constant as the density and flows of medium being dried vary, as well as atmospheric variables. The constant is the load or point at which the impeller reaches stress indicating that the maximum torque or obtainable velocity of the vortices within the process has been achieved The drive motor 93 to run at this load regardless of speed can be programmed as necessary for consistency. The effect of these counter-rotational recoiling speeds travelling up to a theoretical 5000 M per sec traversing over the indentations causes substantial Hydrosonics instantly inducing cavitation. It is supposed that this counter rotational centrifugal vortex moving in an axial radial direction takes up matter amidst temperature increasing dynamic influences and then a previously-disassociated radical oxygen ion aggressively destroys the bacteria.

Also, it appears that the sudden expansion appears to have considerable advantages after what was a previous concentration and centripetal action within the vortex. This violent expansion of the cyclone and its contents produces a pulverizing effect. Further, it has been found, for example, with sewage, that smaller disintegrated matter is discharged to the perimeter for oxidation as the centripetal cyclone reforms itself. As has been stated already, the sudden low pressure atmosphere may cause expansion of gases on water which in turn causes a sudden release of energy as heat. The increase in temperature and accompanying decrease of pressure again aids in the evaporation of any residual water. As has been stated already, it is believed that evaporation is also aided by the pressure differential between the various portions of the cyclone chamber.

Further, the final stages consisting of the final Centripetal forming device sends a competing vortex to the vortex caused either by the disrupter of the earlier invention or the curved tapering blades in its place and they collide with the centrifugal vortex of the impeller causing an ion disruption as the dominating rotational force of each type of vortex approaching 96% creates a massive physical electromagnetic collision which we also suppose tends to atomize and vaporize any remaining free water in a now enhanced vaporizing low pressure atmosphere. It has been observed repeatedly that this apparatus evaporates water at an average rate of 4% of that of a thermal dryer. We are not claiming that there is a correlation between the average power rate and the 96% energy factor in the power of the vortex at full load. The apparatus of the invention as hereinbefore described as stated is an improvement over the above mentioned prior art as it dries less than 1.67% dried solids at a significant reduction of normal energy requirements to figures approaching 75–95% solids depending on the nature of the feedstock and the load on the impeller and leaves little or no deposits in the system.

The term theoretical refers to the scientific community and not the inventor.

In the specification the terms“comprise, comprises, comprised and comprising” or any variation thereof and the terms “include, includes, included and including” or any variation thereof are considered to be totally interchangeable and they should all be afforded the widest possible interpretation.

The invention is not limited to the embodiments hereinbefore described but may be varied in both construction and detail within the scope of the claims.

The invention claimed is:

1. A pneumatic de-watering apparatus or wet product comprising a cyclone chamber connected to a fan with blades, each blade causing individual flow vortices to be formed downstream of the fan which in turn combine to form cyclonic flow within the cyclone chamber characterized in that the cyclone chamber comprises at least a vortex flow forming section having vortex flow forming means to cause reformation of vortex flow within the cyclone chamber on dissipation of the vortex flow along the cyclone chamber remote from the fan.

2. Apparatus as claimed in claim 1, in which the cyclone chamber comprises a vortex flow shedding section fed by the vortex flow forming section.

3. Apparatus as claimed in claim 2, in which the vortex flow shedding section is downstream of the fan, the vortex flow shedding section being arranged and configured such that the individual vortex flows developed by each fan blade are substantially destroyed within the vortex flow shedding section.

4. Apparatus as claimed in claim 2, in which there is more than one pair of vortex flow forming sections and associated vortex shedding section.

5. Apparatus as claimed in claim 2, in which the blades of the fan are arranged to direct the individual vortices to meet at a focal point within the vortex flow shedding section adjacent the fan and the vortex flow forming section feeding that vortex flow shedding section is arranged to direct the main vortex flow to the same focal point.

6. Apparatus as claimed in claim 1, in which the vortex flow is a centripetal vortex flow.

7. Apparatus as claimed in claim 1, in which the vortex forming means comprises a vortex flow forming device substantially centrally mounted within the vortex flow forming section.

8. Apparatus as claimed in claim 7, in which the vortex flow forming device is in the form of an egg with its narrower section facing downstream.

9. Apparatus as claimed in claim 7, in which the vortex flow forming device comprises a substantially ellipsoid body in the form of an egg.

10. Apparatus as claimed in claim 7, in which the vortex flow forming device comprises a substantially ovaloid shaped body.

11. Apparatus as claimed in claim 7, in which the vortex flow forming device comprises a body of reducing cross section from its upstream end to its downstream end.

12. Apparatus as claimed in claim 7, in which additional vortex flow forming vanes are mounted on the interior of the device.

13. Apparatus as claimed in claim 7, in which the vortex flow forming device comprises a plurality of vortex flow forming vanes mounted around a central core.

14. Apparatus as claimed in claim 1, in which the vortex forming device comprises vortex flow forming vanes mounted on an interior surface of the vortex flow forming section.

15. Apparatus as claimed in claim 1, in which the vortex forming section is of reducing cross sectional area towards its downstream end.

16. Apparatus as claimed in claim 1, in which the vortex flow forming section is circular in cross-section.

17. Apparatus as claimed in claim 1, in which the outer portion of vortex flow forming section is oval in cross-section.

18. Apparatus as claimed in claim 17, in which an indentation of arcuate shape is formed in the outer portion of the vortex flow forming section.

19. Apparatus as claimed in claim 18, in which the indentation is spirally wound around the vortex flow forming section.

20. Apparatus as claimed in claim 1, in which the vortex flow forming section is spirally wound along its length about its own longitudinal axis.

21. Apparatus as claimed in claim 1, in which the vortex flow forming section is configured to form a three dimensional spiral.

22. Apparatus as claimed in claim 1, in which the or each vortex flow forming section comprises a reducing cross-section projecting into the vortex flow shedding section.

23. Apparatus as claimed in claim 1, in which the vortex flow forming section comprises vortex flow forming means adjacent where it discharges into the vortex shedding section.

24. Apparatus as claimed in claim 1, in which the vortex flow forming section comprises a straight section of constant cross-sectional area.

25. Apparatus as claimed in claim 1, in which the or each vortex flow shedding section is of greater cross-sectional area than that of the vortex flow forming section downstream of it to provide an—expansion chamber for the main vortex flow.

26. Apparatus as claimed in claim 1, in which the or each vortex flow shedding section comprises a vortex flow shedding device mounted therein.

27. Apparatus as claimed in claim 26, in which the vortex flow shedding device is formed from a plurality of bars projecting transversely across the section.

28. Apparatus as claimed in claim 26, in which the vortex flow shedding device comprises a hollow body expanding in the downstream direction and having an open downstream facing mouth.

29. Apparatus as claimed in claim 26, in which the vortex flow shedding device comprises a hollow prism having an open downstream facing mouth.

30. Apparatus as claimed in claim 26, in which the vortex flow shedding device is a sphere.

31. Apparatus as claimed in claim 30, in which the sphere is hollow and has an open upstream facing mouth.

32. Apparatus as claimed in claim 26, in which the vortex flow shedding device comprises vanes mounted within the vortex flow shedding section to impart contra flow to the main vortex flow.

33. Apparatus as claimed in claim 28, in which the vortex flow shedding device is mounted on the inner wall of the section.

34. Apparatus as claimed in claim 28, in which the interior of the vortex flow shedding device is connected to a vacuum source.

35. Apparatus as claimed in claim 1, in which the or each vortex flow shedding section from its downstream end has an increasing cross-section and then a reducing cross-section.

36. Apparatus as claimed in claim 1, in which a venturi tube is connected between a vortex flow shedding section and a vortex flow forming section to induce a negative pressure in the vortex shedding section.

37. Apparatus as claimed in claim 1, in which at least some of the exposed surfaces of at least some of the sections comprises cavitation forming means.

38. Apparatus as claimed in claim 37, in which the interior walls of at least some of the sections are crimped to form transverse alternate ridges and hollows to provide the cavitation forming means.

39. Apparatus as claimed in claim 37, in which the interior walls are dimpled to form the cavitation forming means.

40. Apparatus as claimed in claim 36, in which the interior wall of at least some of the sections comprises an inner perforated wear plate forming the cavitation forming means.

41. Apparatus as claimed in claim 1, in which an ozone plasma generator is provided.

42. Apparatus as claimed in claim 1, in which the fan blades comprise cavitation forming means.

43. Apparatus as claimed in claim 1, in which the fan housing comprises a vortex shedding section.

44. Apparatus as claimed in claim 43, in which the cavitation forming means is formed by a plurality of through holes in the fan blades.

45. Apparatus as claimed in claim 42, in which the cavitation forming means is provided by a wear plate having through holes.

46. Apparatus as claimed in claim 1, in which the fan discharges into a low pressure environment to prevent water reformation.

47. Apparatus as claimed in claim 46, in which the low pressure environment is provided by a plurality of additional cyclones.

48. Apparatus as claimed in claim 1, in which water bleed-off of pipes are provided along the sections.

49. Apparatus as claimed in claim 1, comprising an ionization device.

50. Apparatus as claimed in claim 1, in which the fan is a centrifugal fan.

51. Apparatus as claimed in claim 1, in which the wall forming the cyclone chamber has mounted on it a magnetic sleeve, the inner wall facing surface having a polarity opposite to that of the ions generated adjacent the inner wall.

52. Apparatus as claimed in claim 51, in which the magnetic sleeve is surrounded by an outer ferrous sleeve.

53. A pneumatic method of dewatering wet product comprising:

introducing the wet product into a cyclone chamber;

delivering air into the chamber;

successively forming and shedding vortices within the chamber to violently treat the product to cause the relevant constituents to atomize, expand, boil, chill, shear, gasify, disassociate and cavitate.

* * * * *